US007490586B1

(12) United States Patent
Weller

(10) Patent No.: US 7,490,586 B1
(45) Date of Patent: Feb. 17, 2009

(54) AUTOMATIC ENGINE OIL CHANGER/RECYCLER SYSTEM

(76) Inventor: Richard G. Weller, 1073 Larkston Dr., Webster, NY (US) 14580

( * ) Notice: Subject to any disclaimer, the term of this patent is extended or adjusted under 35 U.S.C. 154(b) by 650 days.

(21) Appl. No.: 11/108,421

(22) Filed: Apr. 18, 2005

Related U.S. Application Data

(63) Continuation-in-part of application No. 10/619,246, filed on Jul. 14, 2003, now abandoned.

(60) Provisional application No. 60/446,059, filed on May 12, 2003, provisional application No. 60/395,782, filed on Jul. 12, 2002.

(51) Int. Cl.
*F01M 11/10* (2006.01)

(52) U.S. Cl. ..... 123/196 S; 184/104.2

(58) Field of Classification Search ..... 123/3, 123/196 A, 196 R, 572, 196 S, 196 AB, 142.5 E; 184/1.5, 104.2
See application file for complete search history.

(56) References Cited

U.S. PATENT DOCUMENTS

| | | | | |
|---|---|---|---|---|
| 2,483,937 | A | 10/1949 | Rosenblum | |
| 3,447,636 | A | 6/1969 | Bonfilio | |
| 4,354,946 | A | 10/1982 | Warlick et al. | |
| 4,417,561 | A | 11/1983 | Yasuhara | |
| 4,421,078 | A | 12/1983 | Hurner | |
| 4,453,510 | A | 6/1984 | Kupper | |
| 4,495,909 | A | 1/1985 | Hurner | |
| 4,506,337 | A | 3/1985 | Yasuhara | |
| 4,674,456 | A | 6/1987 | Merritt | |
| 4,830,745 | A | 5/1989 | van der Meulen | |
| 4,869,346 | A | 9/1989 | Nelson | |
| 4,971,704 | A | 11/1990 | Johnson, Sr. | |
| 5,353,760 | A | 10/1994 | Zager | |
| 5,390,762 | A | 2/1995 | Nelson | |
| 5,431,138 | A | 7/1995 | Hurner | |
| 5,476,073 | A | 12/1995 | Betts | |
| 5,488,932 | A * | 2/1996 | Serafini | 123/3 |
| 5,562,181 | A | 10/1996 | Elkin et al. | |
| 5,592,395 | A | 1/1997 | Braun | |
| 5,720,249 | A | 2/1998 | Betts et al. | |
| 5,749,339 | A | 5/1998 | Graham et al. | |
| 5,816,212 | A | 10/1998 | Lindquist et al. | |
| 5,964,318 | A | 10/1999 | Boyle et al. | |
| 6,283,082 | B1 | 9/2001 | Gunshore et al. | |
| 6,588,393 | B2 * | 7/2003 | Chamberlin et al. | 123/196 R |

* cited by examiner

*Primary Examiner*—Stephen K Cronin
*Assistant Examiner*—Hyder Ali
(74) *Attorney, Agent, or Firm*—Michael J. Nickerson; Basch & Nickelson LLP

(57) ABSTRACT

A vehicle mounted oil recovery system uses a conduit to transport oil from an engine lubricating system of the vehicle to a retort system, mounted upon the vehicle. The retort system distills the transported oil, through vaporization, into individual components. These vaporized components are further subjected to a slight cooling to separate water and fuel vapor from oil vapor. The oil vapor condenses and returned to the engine lubricating system of the vehicle. On the other hand, the vaporized water and fuel is transported to a fuel system of the vehicle for combustion thereof. The heat needed for vaporization is extracted from an exhaust system of the vehicle by mounting the retort system directly upon the exhaust system. The retort system captures the heat from the exhaust system of the vehicle to provide energy for the vaporization of the transported oil into individual components.

26 Claims, 8 Drawing Sheets

AUTOMATIC ENGINE OIL CHANGER/RECYCLER SYSTEM

PRIORITY INFORMATION

The present application is a continuation-in-part of U.S. patent application Ser. No. 10/619,246, filed on Jul. 14, 2003 now abandoned. The present application claims priority, under 35 U.S.C. §120, from co-pending U.S. patent application Ser. No. 10/619,246, filed on Jul. 14, 2003, said U.S. patent application Ser. No. 10/619,246 claiming priority, under 35 U.S.C. §119(e), from U.S. Provisional Patent Application Ser. No. 60/395,782, filed on Jul. 12, 2002, and claiming priority, under 35 U.S.C. §119(e), from U.S. Provisional Patent Application Ser. No. 60/446,059, filed on May 12, 2003. Thus, the present application also claims priority, under 35 U.S.C. §119(e), from U.S. Provisional Patent Application Ser. No. 60/395,782, filed on Jul. 12, 2002, and from U.S. Provisional Patent Application Ser. No. 60/446,059, filed on May 12, 2003.

FIELD OF THE PRESENT INVENTION

The present invention relates generally to the field of used crankcase oil disposal from gasoline and diesel engines, and more particularly, to effectively eliminating crankcase oil changes and the associated environmental waste by utilizing the engine to recycle the used oil and oil filter residual into quality lubricant and/or engine fuel.

BACKGROUND OF THE PRESENT INVENTION

It is highly desirable to be able to minimize the amount of service required for internal combustion engines to thereby minimize the interruption in the use of the vehicle/equipment. Degradation and contamination of engine lubricating oil during engine use requires oil-changing procedures that account for a significant portion of the maintenance and associated engine down time. Conventional periodic oil changes generate an accumulation of waste lubricating oil that must be disposed of and/or processed resulting in undesirable costs.

Therefore, extending oil drain intervals and reducing waste disposal are of great value to vehicle/equipment operators. Consequently, systems have been developed for automatically changing internal combustion engine crankcase oil during engine operation.

One example of a conventional system automatically changes engine oil while the engine is operating. The system operates to drain substantially all of the used oil from the engine immediately prior to introducing fresh oil into the engine from a reservoir. The operation process results in a complete change of substantially the entire engine oil volume.

However, draining the engine prior to refilling with fresh oil necessarily creates a risk that an inadequate supply of lube oil exists in the engine for an interim time period possibly resulting in damage or excessive wear to engine components from insufficient lubrication. Moreover, this conventional system undesirably results in a quantity of waste oil.

Another example of a conventional system automatically changes engine lube oil during engine operation while avoiding a waste quantity of oil by directing the used lube oil into the fuel system for burning with the fuel in the engine. This example periodically drains a small amount of the used oil from the engine lube oil system and replaces the drained quantity with fresh lubricant from an auxiliary tank.

There are many drawbacks with conventional systems. One example of a drawback is that the oil removal control of some conventional systems could fail to precisely control crankcase oil removal rates, leading to the removal of too much crankcase oil too quickly, resulting in engine failure on the highway.

Another drawback is that some conventional systems do not regulate the amount of crankcase oil that is fed to the fuel tank in accordance with the fuel level in the tank, thus the ratio of crankcase oil to fuel may be too much or two little relative to the ideal ratio. In particular, too much oil in a fuel tank that is not significantly full can result in excess hydrocarbons in the vehicle exhaust, thus contributing to air pollution. Moreover, the addition of crankcase oil to the fuel tank depresses the vapor pressure of the fuel in the tank, thus starting an engine can be more difficult, particularly in cold weather Other conventional systems utilize expensive pumps, control systems and auxiliary waste oil storage tanks, thus decreasing cost effectiveness that tends to discourage widespread implementation.

Lastly, many conventional systems fail to recover the waste oil energy in the oil filter, thereby not resolving the landfill problem of oil seeping from such filters.

In summary, these conventional approaches fail to take care of the used crankcase oil problem in a satisfactory manner. These conventional methods fail to recover the full value inherent in waste oil and oil filters; require consumption of extra energy and material resources; and add to the size of the environmental problem associated with used engine oil.

Therefore, it is desirable to provide a system that effectively utilizes all the resources of used crankcase oil in a satisfactory manner. Moreover, it is desirable to provide a system that recovers the full value inherent in waste oil and oil filters and/or does not require consumption of extra energy and material resources to dispose of the used oil. Furthermore, it is desirable to provide a system that reduces or effectively addresses the environmental problem associated with used engine oil.

SUMMARY OF THE PRESENT INVENTION

A first aspect of the present invention is a vehicle mounted oil recovery system. The vehicle mounted oil recovery system includes a conduit to transport oil from an engine lubricating system of the vehicle and a retort system, mounted upon the vehicle and operatively connected to the conduit to receive the transported oil, to distill, through vaporization and pyrolysis, the transported oil into individual components.

A second aspect of the present invention is a method for recovering used oil using an exhaust system of a vehicle. The method transports oil from an engine lubricating system of the vehicle into a retort system; extracts and conveys combustion heat from the exhaust system of the vehicle to the retort system; and distills, through vaporization and pyrolysis, using the conveyed combustion heat, the transported oil into individual components.

A third aspect of the present invention is an oil recovery system. The oil recovery system includes an adapter to receive a drained oil filter canister, the adapter having an input port and an output port; a solvent source, operatively connected to the adapter, to supply an oil solvent to the input port of the adapter; an oil-solvent mixture collection system, operatively connected to the output port of the adapter, to collect oil-solvent mixture removed from the received oil filter canister; and a vacuum system, operatively connected to the output port of the adapter, to extract residual solvent from the received oil filter canister so as to dry an interior of the received oil filter canister.

A fourth aspect of the present invention is an oil recovery method. The method connects a drained oil filter canister to an adapter; supplies an oil solvent to the connected oil filter canister; removes the oil-solvent mixture from the connected oil filter canister; collects the oil-solvent mixture; and extracts residual solvent from the connected oil filter canister so as to dry an interior of the connected oil filter canister.

A fifth aspect of the present invention is an engine exhaust gas padding system. The engine exhaust gas padding system includes a conduit to transport a portion of post catalytic converted and sound muffled exhaust gas; a corrosion resistant extraction chamber, operatively connected to the conduit, to remove water and exhaust gas particles from the transported portion of the post catalytic converted and sound muffled exhaust gas; an acid-neutralizing canister, operatively connected to the corrosion resistant extraction chamber, to neutralize the acid components within the transported portion of the post catalytic converted and sound muffled exhaust gas; a fine particle filter, operatively connected to the acid-neutralizing canister, to remove fine particles within the transported portion of the post catalytic converted and sound muffled exhaust gas; and a control valve, operatively connected to the fine particle filter, to control an introduction of the acid-neutralized filtered transported portion of the post catalytic converted and sound muffled exhaust gas into a crankcase of an engine.

A sixth aspect of the present invention is a method of gas padding an engine. The method transports a portion of post catalytic converted and sound muffled exhaust gas; removes water and exhaust gas particles from the transported portion of the post catalytic converted and sound muffled exhaust gas; acid-neutralizes the transported portion of the post catalytic converted and sound muffled exhaust gas; fine particle filters the transported portion of the post catalytic converted and sound muffled exhaust gas; and controls an introduction of the acid-neutralized filtered transported portion of the post catalytic converted and sound muffled exhaust gas into a crankcase of an engine.

Another aspect of the present invention is a vehicle mounted oil recovery system. The vehicle mounted oil recovery system includes a retort system, mounted upon the vehicle and operatively connected to receive oil, to pyrolyze and distill the extracted oil into vaporized components. The retort system includes a sloping tube, the sloping tube having a first end and a second end such that the oil drains progressively down from said first end to said second end. The sloping tube has a surface temperature gradient, a surface temperature associated with said first end being less than a surface temperature associated with said second end.

Another aspect of the present invention is a method for recovering oil using an exhaust system of a vehicle. The method extracts combustion heat from the exhaust system of the vehicle; vaporizes, in a retort system, using the extracted combustion heat from the exhaust system of the vehicle, fuel and water from the used oil to produce sludge and an oil of high molecular weight hydrocarbons; and pyrolyzes, in the retort system, using the extracted combustion heat from the exhaust system of the vehicle, the sludge and oil of high molecular weight hydrocarbons into low molecular weight hydrocarbon vapors.

BRIEF DESCRIPTION OF THE DRAWINGS

The present invention may take form in various components and arrangements of components, and in various steps and arrangements of steps. The drawings are only for purposes of illustrating a preferred embodiment and are not to be construed as limiting the present invention, wherein.

DETAILED DESCRIPTION OF THE PRESENT INVENTION

Figure 1:
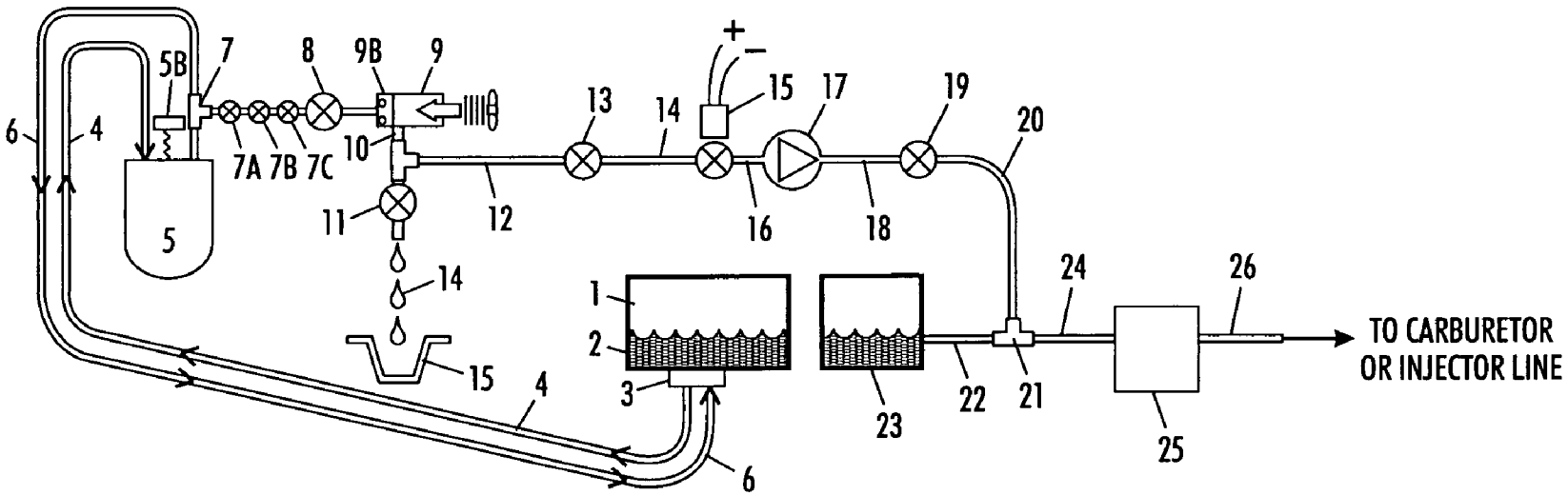
FIG. 1 is an illustrative schematic of one embodiment of an apparatus for recovering the fuel value of used crankcase oil according to the concepts of the present invention.

The present invention will be described in connection with preferred embodiments; however, it will be understood that there is no intent to limit the present invention to the embodiments described herein. On the contrary, climate, engine usage patterns, and other factors may dictate need for different combinations and configurations of the various elements of the present invention, thus the intent is to cover all alternatives, modifications, and equivalents as may be included within the spirit and scope of the present invention as defined by the appended claims.

For a general understanding of the present invention, reference is made to the drawings. In the drawings, like reference have been used throughout to designate identical or equivalent elements. It is also noted that the various drawings illustrating the present invention are not drawn to scale and that certain regions have been purposely drawn disproportionately so that the features and concepts of the present invention could be properly illustrated.

In the various descriptions below, it is noted that the amount of piped vapors is small and not much more than the amount of vapors already piped by existing engine systems; however, in the interest of backup safety, it is to be understood that all vapor tubing for the present invention may be equipped with fire suppressing screening until such time as this feature is deemed to be unnecessary for the specific configuration utilized.

Moreover, for the sake of clarity, the various components in the drawings may be shown without all of the otherwise typical and obvious features. For example, a fuel line may be represented by a featureless line even though it is well known to those skilled in the art that such fuel lines may be comprised of several segments plus linking hardware, such as ferrules, fittings, threaded nuts, and the like.

Turning to the description of the present invention, FIG. 1 is an illustrative schematic of apparatus of a burn method according to the concepts of the present invention, which recovers the fuel value of crankcase waste oil by efficiently burning it as fuel in the engine.

With reference to FIG. 1, at an engine crankcase 1, used crankcase oil 2 leaves an engine through a remote oil filter adapter 3 and unfiltered oil line 4 for a remote oil filter 5 and thence returns via line 6 back to the engine oil filter adapter 3. Return filtered oil line 6 is tapped to provide filtered oil under pressure into line 7 through normally open valve 8 thence through orifice filter 9B, thence to needle valve 9.

It is noted that line 7 may include a shut-off valve 7A and additional valves 7B, 7C, etc. to allow the injection of other products between shut-off valve 7A and valve 8, such as: oxygenated fuel to reduce air pollution when the engine idles; anti-knock liquids to improve engine performance when the engine is under load; and/or combustion catalysts into the fuel line along with the oil being burned to obtain full energy recovery from the waste oil being burned and which can facilitate cold engine starts under cold climatic conditions.

From needle valve 9, the metered filtered oil flows through tube 10 to normally closed valve 11 and through tube 12 to normally open valve 13. The flow through needle valve 9 may be measured by closing valve 13, opening valve 11, and counting the rate of oil drops 14 falling into a container 15. From this measurement, the needle valve 9 may be adjusted as required to obtain the desired flow rate.

During ongoing operations, valve 11 is closed, and valve 13 is opened to allow oil to flow through line 14 thence through automatic valve 15. The automatic valve 15 is closed until the temperature of engine coolant reaches a predetermined desired level. In a preferred embodiment the predetermined desired level is about 190 degrees Fahrenheit. Moreover, in a preferred embodiment, the engine speed is significantly above idle before the automatic valve 15 is opened to let the oil flow through line 16. The automatic valve 15 closes any time these two conditions are not met. Thereafter, the oil flows through check valve 17, which lets the oil flow forward through line 18 but protects against any backward flow. The oil flows through valve 19, which is normally open, through line 20 to T-fitting 21 that connects with a fuel line 22 from a fuel tank 23. A fuel line 24 leading from T-fitting 21 to a fuel filter 25 allows mixed crankcase oil and fuel to flow to an engine carburetor, fuel injector, via line 26.

In an alternative embodiment, the crankcase oil is introduced at the intake manifold and/or intake manifold side of the intake manifold air cleaner. More specifically, the oil can be injected directly into the engine fuel-air manifold, thus bypassing the fuel line. If the oil is injected in the same area as the fuel from a carburetor venturi or a throttle body fuel injector, this enhances fuel/oil mixing. The high pressure in the oil line and the low pressure of the manifold facilitate atomizing of the oil.

Combustion may or may not be as efficient as mixing the oil with fuel in the fuel line. Nevertheless, this embodiment has the advantage that it allows cold engine startup with pure fuel whereas premixing, even though it is stopped prior to engine shutdown, may still have a little bit of oil remaining in the system, such as in the carburetor float bowl. Another value of this approach is, if the oil and fuel are not completely mixed, the oil can perform a better lubrication of the upper cylinder, the valve stems, and faces, which is beneficial because these areas of the engine tend to be deficient in lubrication due to the severe conditions involved.

In a further embodiment, the oil injection can be moved away from that area and closer toward the engine rather than in the fuel atomization area. This relocation results in less oil and fuel mixing, thereby allowing more lubrication to the upper cylinder areas.

In a still further embodiment, a small portion of pressurized fuel can first be taken from the fuel line before the oil is introduced, with a one-way valve therebetween, and delivered, via a supplementary fuel line, to the engine for cold starts, thereby enabling a cold start to utilize pure fuel.

In another embodiment, pressurized fuel is taken from the fuel line after the fuel filter, and delivered, via a supplementary fuel line, to a small chamber. The amount entering the chamber is restricted by an orifice and/or needle valve. Used oil to be burned, previously metered by a needle valve with the apparatus as previously described, is delivered to the same chamber. The used oil and the fuel lines and their streams converge in the chamber at one end and mix, thence the mixture is injected out the other end directly into the manifold. The benefit is intimate mixing of fuel and oil for efficient combustion yet it can be completely shutoff when the engine goes to idle thus cold engine startup is done with fuel completely free of oil.

This supplementary fuel line going to the oil and fuel mixing area is of small diameter, contains a fuel limiting orifice, check valve, needle valve, and an automatic ON/OFF valve controlled by the same parameters of engine temperature and speed significantly above idle as described above.

The mixing chamber can be as simple as a short tube, about ½ inch long and about ¼ inch in diameter. The combination of high-pressure oil and moderate pressure fuel plus the vacuum of the manifold enables the atomization of the mixture in the manifold.

Moreover, air can be injected in the end of the mixing tube to increase the degree of atomization of the mixture. Air for this purpose can be metered with an orifice directly from the ambient air after passing through a filter or it can come from a tube connected to the intake manifold air cleaner connected just inside the air filter.

The apparatus and variants for oil insertion described above can be utilized for additional purposes related to environment and energy efficiency.

Using the same apparatus for oil burning, with any of the variants, the oil from the oil filter may be shut off using a valve next to the filter in the burn oil line. Then a liquid delivery line, coming from an auxiliary tank can be attached via a T-fitting in the burn oil line. The T-fitting leading to the line of the auxiliary tank would be equipped with a shutoff valve, as would the end of the line from the auxiliary tank. The line from the auxiliary tank would have liquid under pressure, either gravity or a small supplemental pump.

The purpose of this setup is that special liquids could be delivered to the fuel line or the engine manifold. Of particular interest would be liquids such as oxygenates, which could be delivered when the engine temperature is low and engine speed is low, octane boosters when the engine is under load; engine treatments, such are done for de-coking/de-carbonizing the engine valves.

For these treatments, special solvents are burned in the engine for a prescribed period of time. These services can be expensive. When done with one of the variants of the present invention, the savings can pay for the apparatus of the invention. Car engines cleaned in such a manner can run more efficiently, thereby saving on fuel energy and with less air pollution.

A fuel pump, not shown since the location varies between different engines, is typically located prior to the fuel filter. Fuel pressure is usually not a problem because oil line pressure is typically higher than fuel line pressure. For fuel injection systems requiring a return fuel line to the fuel tank, adding oil to the fuel line is not preferred because oil can then flow into the fuel tank, which can make engine startup more difficult particularly in cold weather. There will be oil in the fuel at all times which can be foul spark plugs and create smoking when the engine is idling and/or cold. Also, suspended particles in the oil can separate out in the fuel tank upon dilution thus creating sediment in the fuel tank which can agglomerate and cause sludge problems.

Thus for fuel injected engines, the crankcase oil to be combusted can be injected into the engine air intake manifold. Air, metered and filtered from the ambient or from the engine side of the air cleaner may be injected with the oil to facilitate atomization. The air may additionally be heated by obtaining it from any hot area of the engine. A small amount of fuel may additionally be injected along with the oil to be burned to further facilitate atomization and efficient combustion.

The fuel would be supplied from a small supplementary fuel line attached to the main fuel line. From that point, the fuel line system would be nearly identical to the oil supply line, that is starting from the fuel line, it would have a shutoff valve, secondary filter, needle valve, shutoff valve, temperature/engine speed controlled automatic valve, check valve, and shutoff valve.

For a carburetor venturi, or a carburetor mounted fuel injector, the oil could be injected into or close to the same area as the fuel being atomized. Injecting the oil to be combusted into the air intake manifold has the benefit (a) that no residual oil remains anywhere in the system for engine startup; and (b) fresh fuel is always available for this purpose.

Injection of oil into the manifold can be altered to provide another benefit. Any oil in the air-fuel intake system can be beneficial for valves and top cylinder lubrication since these areas are typically hard to keep lubricated. Injecting the used oil closer to the cylinder intake can supply the oil in a less atomized form that is better for lubrication when better top cylinder lubrication is desirable.

As illustrated in FIG. 1, at the T-fitting 21, the filtered oil is injected into the fuel of fuel line 24 coming from the fuel tank 22. The low flow rate of oil being injected into the relatively higher flow rate of gasoline (about 100 times more) results in mixing of the oil into the gasoline. When the initial mix of oil and gasoline is pumped through the small pores of the fuel filter 25, the process mechanically breaks up the flow into huge numbers of micro-flows resulting in intimate mixing of the oil and gasoline which subsequently exits to the carburetor or fuel injector, which further mixes the fuel in the atomization process.

The filtered crankcase oil from the precision metering process, described above with respect to FIG. 1, is injected in small amounts to the engine combustion process, the feed rate being such as to feed the entire crankcase and filter volume to the engine in the course of traveling, for example, 3000 miles. In a normal maintenance fashion, fresh makeup oil is added to the crankcase, as needed, which over the course of 3000 miles will totally replace the crankcase oil consumed. The end result is that crankcase oil never has to be drained; yet the contaminant levels never reach the levels of contaminants that accumulate using current methods that do not change oil until after 3000 miles of use.

This process utilizes intimate mixing of the oil into the gasoline (or into a diesel intake manifold or with a small amount of diesel fuel into the diesel intake manifold) at a ratio of about one part oil per 140 or 280 (or more) parts of gasoline (or diesel oil for a diesel engine). Thus, by mixing at such a high ratio and by restricting the oil injection to only when the engine temperature is high (about 190 degrees Fahrenheit or more) and engine speed is significantly above idle, the combination results in high combustion efficiency, thereby recovering the energy content of the oil while maintaining acceptable exhaust gas quality.

It is also contemplated that this process can be utilized with an auxiliary supply tank, filter, with gravity feed or miniature positive displacement pump, to burn oil from a source other than the engine crankcase of the vehicle the apparatus is installed in. The same system can be used to burn other fuels, such as high oxygenate types, which can be used in tandem with the oil burning installation to improve exhaust emission characteristics.

Referring back to FIG. 1, as noted above, valves 7B, 7C, and others could be added to line 7 between valve 7A and valve 8 so that the special fuels can be fed with the present invention. The present invention may also be used with any fuel additive when the engine benefits from it, such as non-smoking additive only when the engine is idling or it can be fed an octane booster or anti-knock additive when the engine is under load, thus the additive does not have to be used all the time resulting in a cost savings versus having to add the additive to the entire fuel tank.

The same system can be utilized to feed special solvents such as presently used to de-coke or de-carbon engine valves after about 100,000 miles usage. The stated purpose of the treatment is to improve engine efficiency, which reduces fuel usage and decreases exhaust pollutants, thus benefiting the environment.

It is pointed out that engines already burn oil from the crankcase. The present invention accelerates this rate but does so more efficiently. To explain, oil burning that currently takes place is accidental, that is, the engine is designed to save oil, not to burn it, which results is inefficient vaporization of the oil followed by inefficient oil combustion with loss of fuel value, generation of smoking tendency, and increased hydrocarbon air pollution. This occurs because the oil is in film form against a relatively cool cylinder wall cooled by the vehicle engine coolant system resulting in poor atomization of the oil which gives rise to inefficient combustion.

By comparison, the present invention intimately mixes oil into the gasoline fuel, the mixing starting when oil is injected into the fuel line then further mixing by action of the fuel filter which breaks up the gasoline-oil mix into a huge number of micro-flows thus achieving intimate mixing, which allows the mixture to be fully vaporized in the combustion chamber, which vaporization process further mixes the fuel, thence followed by efficient combustion to recover the fuel value and do so with little or no change in exhaust properties following the catalytic muffler.

As described above, this embodiment of the present invention can burn the used oil efficiently with little or no adverse impact on air pollution. The present invention also contemplates burning oil at a higher engine compression ratio which can increase overall engine efficiency or utilizing crankcase oil formulated specifically for burning as well as adding combustion catalysts to the fuel. It is noted that synthetic oil can be utilized to extend useful life of the oil thus reducing the amount of oil to be burned which increases the fuel to oil ratio, and thence combustion efficiency, of the oil to be combusted.

Furthermore, the presence of filtered oil in the ingoing air and fuel to the engine combustion chamber can be beneficial in providing some lubrication to the upper part of the combustion chambers that tend to be less well lubricated than other parts of the engine.

The present invention, as described above, offers the benefits of relatively low cost and ease of installation, making it applicable to most vehicles, particularly in modern engines with severely congested engine compartments, and the economics of implementation make it of particular value to the National interest in that the benefits of savings in energy, savings in resources, decrease in need for imported oil, and reduction of environmental pollution, can be realized very quickly.

For the embodiments described above, it is contemplated by the present invention to utilize additional valves and/or connections between the oil filter output line and the needle valve to provide the following:

(a) Being able to disconnect the unit from the oil filter output line but still enable the engine and oil filter circuit to operate without affecting the oil filtration or the operability of the engine;

(b) Being able to obtain oil from the oil output line without changing the setting of the needle valve; i.e., the first valve can be opened from the oil filter line, the second valve can be opened to a sample cup, the third valve being ahead of the needle valve is closed thus no oil enters or leaves the needle valve when this situation is so desired;

(c) Allowing the connection of a source of liquid to the second valve in above paragraph. When the first valve is closed and the third valve opened, this enables liquid such as oxygenate, octane booster, cleaning solvent, to be pumped (or gravity fed) to the needle valve which meters it to the destination desired, for example, the fuel line or intake manifold.

In the various descriptions, alkalizing materials are given as examples. These examples should not be limited to inorganic materials but rather should include any compound, including available organic liquids such as amines, that can react with acid in the oil to neutralize that acid and can also include materials that absorb water and hold water, such as particles of silica gel and cellulose since removal of water prevents the acid from forming.

In another embodiment of the present invention, oil filter contents are additionally utilized for fuel energy by hot-draining the oil filter at a desired interval, such as at 3000 miles (that is, draining the oil filter while it is still hot from engine use, which lowers oil viscosity and permits better draining). It is noted that that a screw 5B, in FIG. 1, locate at the top of the remote filter 5 allows some models of the backflow prevention valve of a spin-on-type oil filter to open so as to facilitate hot draining.

Figure 2:
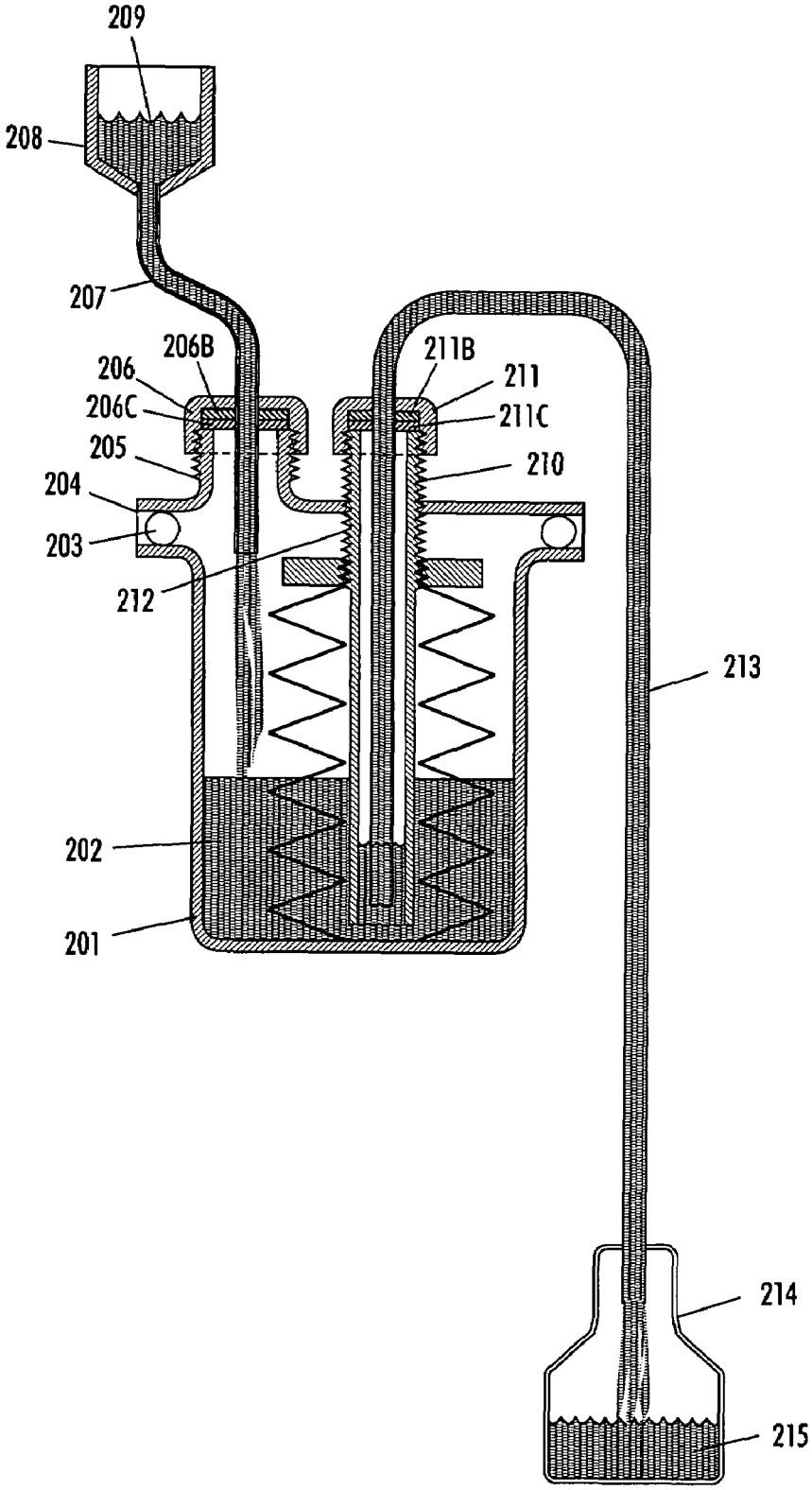
FIG. 2 is an illustrative schematic of one embodiment of an oil filter flushing and evaporation adapter for recovering used crankcase oil according to the concepts of the present invention.

Then the drained filter is attached to an adapter and a small amount of gasoline is poured through the filter to extract the small amount of residual oil. The oil-gasoline mixture is then blended into a full gasoline tank of the vehicle. The oil filter and adapter are connected to an engine's vacuum line leading to the engine intake manifold that draws out the fumes for combustion and dries the oil filter canister. The dry cleaned canister can be disposed of at the next oil change or conveyed to a metal recycling program. FIG. 2 illustrates in more detail this apparatus and procedure.

As noted above, FIG. 2 is an illustrative schematic of a manual oil filter flushing and evaporation adapter, which can recover useful fuel oil from a filter by solvent extraction and subsequent use as fuel in the engine. The oil filter canister 201 is a standard spin-on type, but the process of the present invention is not limited to this type of filter.

Used oil to be removed is absorbed in filter element 202. The oil filter canister 201 is attached to an adapter top 204 by a threaded connection of 212. As in a standard engine connection, gasket 203 seals the connection. An inlet flushing tube 207 is connected to an adapter threaded filter inlet 205 by threaded collar 206 to supply gasoline solvent to the inlet section of the oil canister 201.

Gasoline solvent 209 (or diesel fuel component in the case of a diesel filter) is poured into the funnel 208, which enables it to travel into the filter canister 201 to the inlet side of the filter element 202. The gasoline solvent 209 travels through the filter element 202 extracting the absorbed oil. The contaminants trapped by the filter remain in the filter since the flow direction is the same as when the oil was filtered. The oil-gasoline mixture then travels out the threaded filter outlet 210 by the outlet siphon tube 213, which has been connected and sealed to the filter adapter top 204 by threaded collar 211. The oil gasoline mixture 215 flows into a collecting container 214. The oil gasoline mixture 215, of which the oil content is very small, can then be blended and diluted into a vehicle's fuel tank. Tubes 207 and 213 are sealed to collars 206 and 211 by gaskets (206B, 211B) next to the collars, thence metal washers (206C, 211C), thence another set of gaskets (same as 206B, 211B, but omitted from FIG. 2 for clarity). The combination of gaskets and washers both seal the connections against leaks and compress the gaskets against the tubes thus holding them firmly in position when tight, but enabling up and down movement when the collars are loosened.

In the solvent extraction procedure, gasoline solvent is poured into the funnel until the gasoline-oil flows out through the outlet siphon tube. When pouring of the gasoline stops, the outlet siphon tube, which extends to the bottom of the filter, then empties the filter canister by siphon action. Thus the remaining filter has a small amount of gasoline solvent remaining in the canister walls and in the filter element, but the oil content is substantially extracted out of the canister and filter element.

Following the solvent extraction process, the inlet flushing tube and the threaded collar are removed and the threaded collar replaced with a cap. Then, the outlet siphon tube is removed and the apparatus is connected to a fuel manifold vacuum tube via the threaded filter outlet and left connected until the next filter change. The continuous vacuum applied to the apparatus evaporates and dries the gasoline from the filter, with the fumes going to the intake manifold for the combustion process. The canister then can be recycled for the canister value, or for metal value, or it can be disposed of in the municipal waste.

The same process and apparatus can be utilized for a diesel engine oil filter except that gasoline is generally not recommended for adding to diesel fuel, rather one of the lower boiling point components of diesel fuel would be a preferred solvent. Thence the canister would be connected to an intake manifold vacuum line in a warmed part of the engine compartment and dried prior to being disposed of at the next filter change. The canister then can be recycled for the canister value, of for metal value, or it can be disposed of in the municipal waste.

Figure 8:
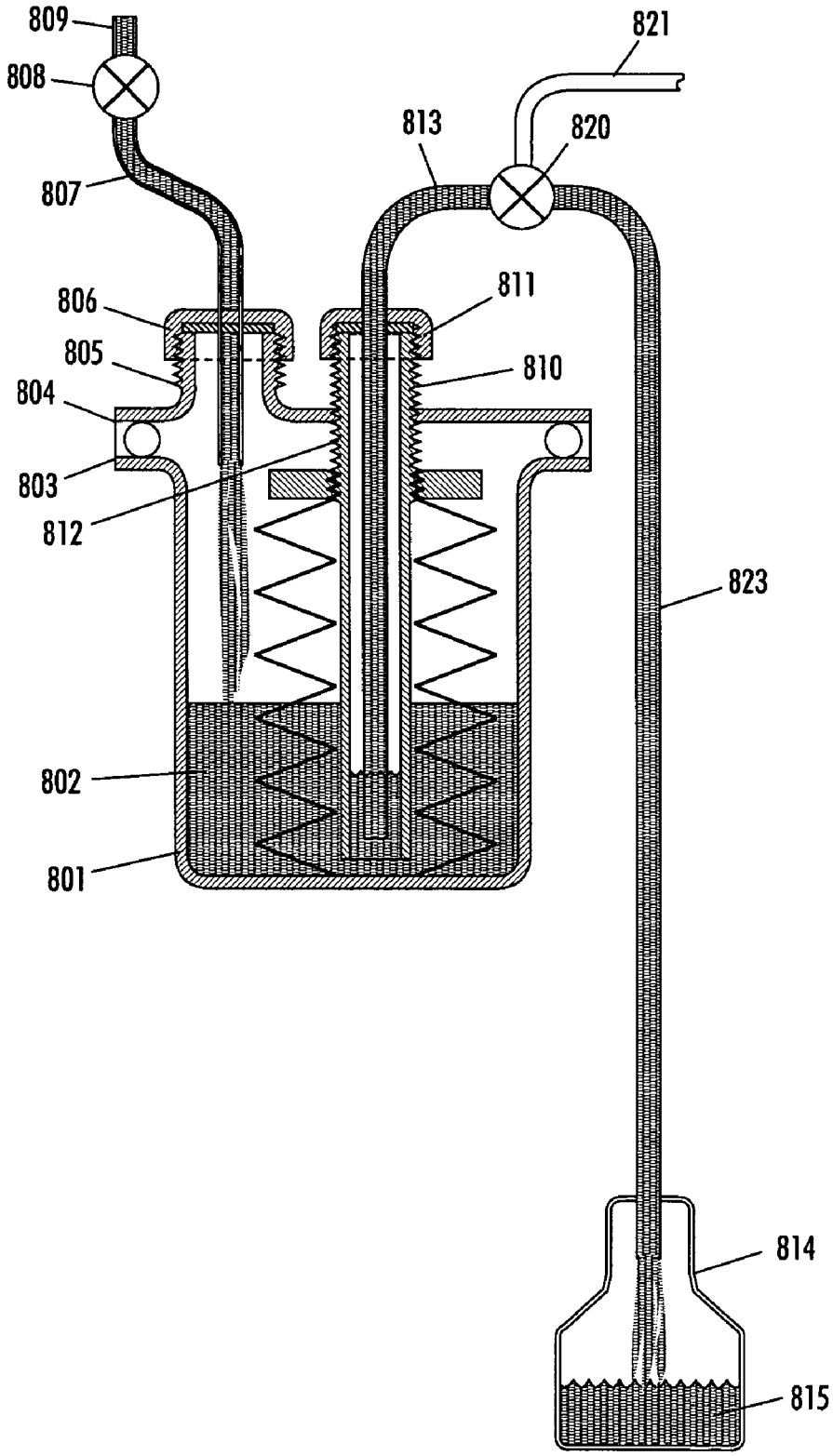
FIG. 8 is an illustrative schematic of one embodiment of an oil filter flushing and evaporation adapter for recovering used crankcase oil according to the concepts of the present invention.

FIG. 8 is an illustrative schematic of an engine-mounted automatic oil filter flushing and evaporation adapter, which can recover useful fuel oil from a filter by solvent extraction and subsequent use as fuel in the engine. The oil filter canister 801 is a standard spin-on type, but the process of the present invention is not limited to this type of filter.

Used oil to be removed is absorbed in filter element 802. The oil filter canister 801 is attached to an engine-mounted adapter 804 by a threaded connection of 812. As in a standard engine connection, gasket 803 seals the connection. An inlet flushing tube 807 is connected to an adapter threaded filter inlet 805 by threaded collar 806 to supply gasoline solvent from a fuel system of the vehicle to the inlet section of the oil canister 801.

Gasoline solvent line 809 is connected to valve 808, which controls the flow of gasoline solvent through the filter canister 801 via the inlet side of the filter element 802. The gasoline solvent travels, when valve 808 is open, through the filter element 802 extracting the absorbed oil. The contaminants trapped by the filter remain in the filter since the flow direction is the same as when the oil was filtered. The oil-gasoline mixture then travels out the threaded filter outlet 810 by the outlet tube 813, which has been connected and sealed to the filter adapter 804 by threaded collar 811. The oil gasoline mixture 815 flows out of the filter canister 801, through a multi-outlet valve 820 that during the solvent extraction procedure directs the oil gasoline mixture 815 into a collecting container 814 via tube 823. The oil gasoline mixture 815, of which the oil content is very small, can then be blended and diluted into a vehicle's fuel tank. It is noted that the oil gasoline mixture 815 could also flow directly to the vehicle's fuel tank and thus collecting container 814 is not needed.

In the solvent extraction procedure, gasoline solvent is pumped into the filter canister 801 via gasoline solvent line 809 is connected to valve 808. When the injection of the gasoline solvent is completed, the outlet tube 813, which extends to the bottom of the filter, empties the filter canister by siphon, vacuum, or pump action. Thus, the remaining filter has a small amount of gasoline solvent remaining therein, but the oil content is substantially extracted out of the canister and filter element.

Following the solvent extraction process, the valve 808 is closed. Then, the multi-outlet valve 820 is also, at this time, reconfigured so that tube 823 is no longer in direct communication with outlet tube 813, but outlet tube 813 is now in communication with tube 821. This reconfiguration of multi-outlet valve 820 allows the filter canister 801 to be connected to a fuel manifold vacuum system via tube 821. The continuous vacuum applied to the filter canister 801 via reconfigured multi-outlet valve 820 and tube 821, evaporates and dries the gasoline from the filter canister 801, with the fumes going to the intake manifold for the combustion process. The filter canister 801 then can be recycled for the canister value, of for metal value, or it can be disposed of in the municipal waste.

The same process and apparatus can be utilized for a diesel engine oil filter except that gasoline is generally not recommended for adding to diesel fuel, rather one of the lower boiling point components of diesel fuel would be a preferred solvent. Thence the canister would be connected to an intake manifold vacuum line in a warmed part of the engine compartment and dried prior to being disposed of at the next filter change. The canister then can be recycled for the canister value, of for metal value, or it can be disposed of in the municipal waste.

The bottom draining oil filter of the present invention uses a manual valve to bypass the check valve so as to allow the draining of the oil filter canister to an oil level that is below the level of the replaceable filter element. This minimizes the chance of burns from hot draining oil since no oil is exposed to burn the skin.

As noted above, there are two important features to this embodiment: (1) being able to hot drain the filter oil, the hot condition lowering oil viscosity thereby producing efficient draining of the oil; and (2) being able to drain the hot oil safely without the risk of hot oil burns to the skin.

Figure 3:
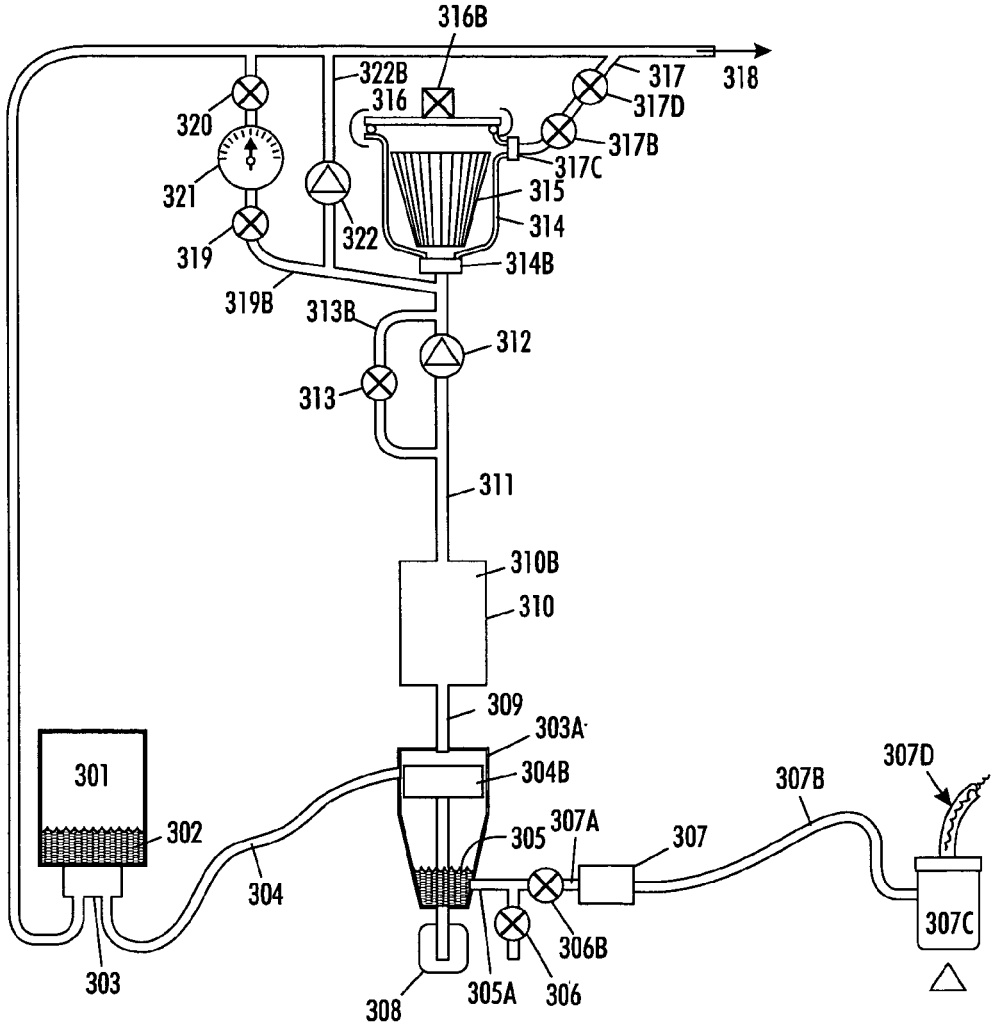
FIG. 3 is an illustrative schematic of one embodiment of an oil life extender system according to the concepts of the present invention.

FIG. 3 is an illustrative schematic of an oil life extender system with separate components, which neutralizes acids, removes sludge and water, and permits monitoring of oil filter effectiveness according to the concepts of the present invention.

As illustrated in FIG. 3, at engine 301, crankcase oil 302 leaves the engine through the remote oil filter adapter 303 and the unfiltered oil line 304 thence to a conveniently mounted (such as under the hood in the engine compartment) cyclonic/centrifugal sludge remover 303A. Device 303A is a conical shaped canister that has the inlet unfiltered oil line 304 joining the conical canister 303A at an angle tangent to the canister side, in order to set up cyclonic action by incoming oil velocity which would favor heavier oil components collecting toward the periphery of the canister, which heavier components such as sludge 305 and water then migrate by gravity and collect in the vertex of the conical canister.

The collected sludge 305 then flows through line 305A to valve 306 where it may then be manually drained periodically. However, it is preferred that the sludge 305 flows through valve 306B thence through tube 307A to the miniature positive displacement pump 307, which is preferably of the gear type (which type is rugged, can perform heavy pumping, can operate reliably at low speed, and can perform metering) and which then pumps the sludge 305 through the line 307B to an exhaust gas retort 307C embedded in the engine exhaust manifold, which retort turns the sludge to fuel vapors which are conducted by tube 307D to the intake manifold of the engine and thence to the combustion process to be consumed as fuel. Oil from which the sludge has been removed then flows upward through the low velocity center portion of the spinning oil and out of the canister by line 309.

Returning back to the cyclonic/centrifugal sludge remover 303A, it is preferable to add a powered centrifugal device, such as a radially finned disk represented by 304B powered by the motor 308, in order to substantially enhance the centrifugal sludge separating action. It is to be noted that shapes used in the drawings are intended to be representative of the ideas disclosed but are not to be construed as limiting the shapes which may be employed.

Centrifugal processing of the waste oil removes various undesirable components, including particles that could plug the subsequent oil filter pores, particles too small to be captured by the subsequent oil filter, and water. Removing this sludge significantly improves oil quality that reduces the amount of oil per mile that needs to be burned by the present invention and it increases the oil filter life by reducing the rate of pore blocking in the filter.

Corrosion from acid is recognized as a key cause of reducing engine life. Adding makeup oil to the engine crankcase provides alkaline components that help to neutralize acid products. However, when oil is used for long periods without adding new oil, then to maintain oil quality, a means to neutralize acid is needed. Since much of the acid is contained in water in the crankcase oil and since water tends to make sludge-like mixtures, the centrifugal sludge removal not only removes water but also removes acids combined with it.

De-sludged oil moves from tube 309 to an acid-neutralizing canister 310 with alkalizers 310B that neutralize acidic components not removed with the sludge 305. Since the sludge removing process of the present invention already removed acid water and other acidic sludge, the acid-neutralizing canister 310 only has to neutralize the acid that escaped the de-sludging process, thus resulting in longer life for the alkalizing contents of this device. Alkaline materials inside the canister achieve acid neutralizing in the canister, such materials being in a permeable form, such as pea-sized beads, to allow the oil to contact the materials yet flow through the canister without undue resistance. A screen inside the canister would retain the beads until they are mostly consumed and of small size, after which they might pass through the screen but they would be contained by the subsequent oil filter element where they would continue to neutralize acid.

Acid formation depends on the presence of water. The alkaline components utilized also absorb water even if acid neutralizing did not take place. Other components of the acid-neutralizing canister absorb water and therefore decrease acid formation. Cellulose and silica gel are two examples, but water-absorbing components are not limited to these. Later in this description, another part of the present invention will be described which removes both water and gasoline from the crankcase oil.

In FIG. 3, the acid-neutralizing canister 310 follows the centrifugal sludge removal; however, because of the many variables and the many types of potential applications, it may be desirable to reverse this order, with the acid-neutralizing canister 310 coming before the sludge removal. For example, changing liquid sulfuric acid to a gelatinous agglomerate of calcium sulfate and water would make it easier to centrifugally remove the sulfate chemical from the oil, plus the gelatinous agglomerate could remove small undesirable particles that will go through a standard oil filter.

Desirable acid neutralizing materials include carbonates, hydroxides, and bicarbonates of calcium, magnesium, and sodium, but not limited to these inorganic compounds. Organic bases can also be utilized; akyl and aryl amines are examples of types, but the application is not limited to these. All of these compounds can be used alone or in combination, in solid form such as in pea-sized beads, or in a matrix, such as in a paper element, or as encapsulated liquids that are slowly released in a chemical response to oil acidity.

Calcium, such as calcium hydroxide, is desirable for reacting with sulfuric acid to form calcium sulfate particles that can subsequently be filtered in the oil filter or before the oil filter. However, coating of remaining calcium hydroxide with insoluble calcium sulfate can render the remaining calcium hydroxide unavailable for neutralizing acid. For this reason, combining the calcium with sodium and magnesium alkalizers can result in improved efficiency.

Magnesium based alkalizers are desirable when it is desirable to have the neutralization product soluble, which enables it to be subsequently removed in a different manner, such as by absorption into a paper element. A neutralization product which remains soluble when in the water content of the crankcase oil is preferable to one forming particles in the crankcase that could increase abrasive wear in the crankcase. The present invention is not limited only to the alkalizers of these examples.

An alkalizing device, such as in canister form, separate from or combined with an oil filter, can have its residual oil removed and consumed as fuel, using gasoline as a solvent in the manner previously described for a used oil filter. For a diesel engine, gasoline solvent is not recommended for flushing filters and canisters if the mixture is to be utilized in a diesel fuel tank, rather a low boiling solvent component of diesel fuel would be recommended.

From the neutralizing canister 310, the oil would flow through the line 311 thence through check valve 312 thence to the oil filter canister 314. Check valve 312 in this example would keep oil from flowing back to the crankcase when the engine is not running. The valve 313 would normally be closed, but is opened to enable hot draining of the oil from oil filter canister 314 through bypass tube 313B when it is desired to change the oil filter element in this canister.

The oil filter canister 314 with removable filter element 315 is not a standard oil filter but could be made available. (A standard spin-on canister filter could be used in conjunction with the remote oil filter adapter noted earlier in this disclosure; but for this illustration, it is useful to employ the concepts of oil filter 315 in oil filter canister 314.)

The canister/filter configuration shown makes it easy to hot drain the filter in a safe manner without risking burns from the hot oil simply by opening bypass valve 313 that allows the filter oil to drain via by-pass tube 313B. A vent valve 316B on top of cover 316 may additionally be opened to speed up the draining process. If air pressure were used to assist draining (described below) vent valve 316B would be closed.

To provide air assist for draining, first, valve 317D is shut off. A low volume air pump is connected into line through a fitting 317B near the fitting 317C. Then air is pumped into the space over the outlet side of oil filter element 315 which forces more absorbed oil out of the filter element 315 thus the residual oil in the replaceable element is largely removed. Thence the element can be pressed out by hand, and/or put into a retort, or disposed of in the trash.

The removable filter element 315, removed via access cover 316 and a cover clamp (not shown) can then have its contents recovered as fuel vapor by placing it in the retort 307C and letting it bake until the next oil filter change.

The oil filter canister 315 can also be disconnected at fittings 314B and 317C then washed with solvent poured into the bottom opening of oil filter canister 314, with the outflow collected from the opening of the canister at 317D. The filter element 314 can be removed and the solvent reclaimed as fuel by crunching the element into a small ball, followed by inserting it into a small chamber connected to the vacuum manifold of the engine. This type of removable filter is economical and easy to change, thereby encouraging more frequent maintenance of the system.

In operation, filtered oil, with reduced acidity, reduced water, reduce sludge, reduced particles, under pressure, leaves through tube 317 to be returned to the engine crankcase, and it is also provided to tube 318 which leads to the metering and the burning process of the present invention; and/or the system could also be utilized in part or in total to reduce oil processing rate utilizing the retort method of the present invention, as previously and subsequently described.

Additional features of this part of the present invention include relief valve 322 which opens to bypass the oil filter 315 thereby providing oil to line 317 and thence to the engine 301 if the oil filter becomes clogged. The gauge 321 in oil line 319B can be used to measure oil pressure entering the filter 315 by closing valve 320 and opening valve 319. The pressure on the outlet side of the filter 315, which is the pressure supplying the engine, can be measured by closing valve 319 and opening valve 320. By monitoring the difference in these two pressures, one can tell precisely when the filter needs to be changed, which can save the engine from running dirty oil when the oil bypasses a clogged filter. It can also save money by eliminating premature changing and discarding a filter that still has significant filtration life remaining.

The above canister/filter element illustrates use of a non-disposable canister in conjunction with a disposable filter. Using a non-disposable canister, that is, one that is continuously reusable, saves a huge amount of materials and energy compared to the amounts required to manufacture the spin-on type canisters mostly used today. By comparison, the disposable filter element of the present invention is lightweight, non-bulky, and economical in manufacturing materials and energy, and the absorbed oil energy value fully recoverable. And, the purchase price can be low thereby encouraging more frequent filter changing resulting in better engine protection and longer engine life, thereby saving on resources needed to replace the worn out engine.

Figure 4:
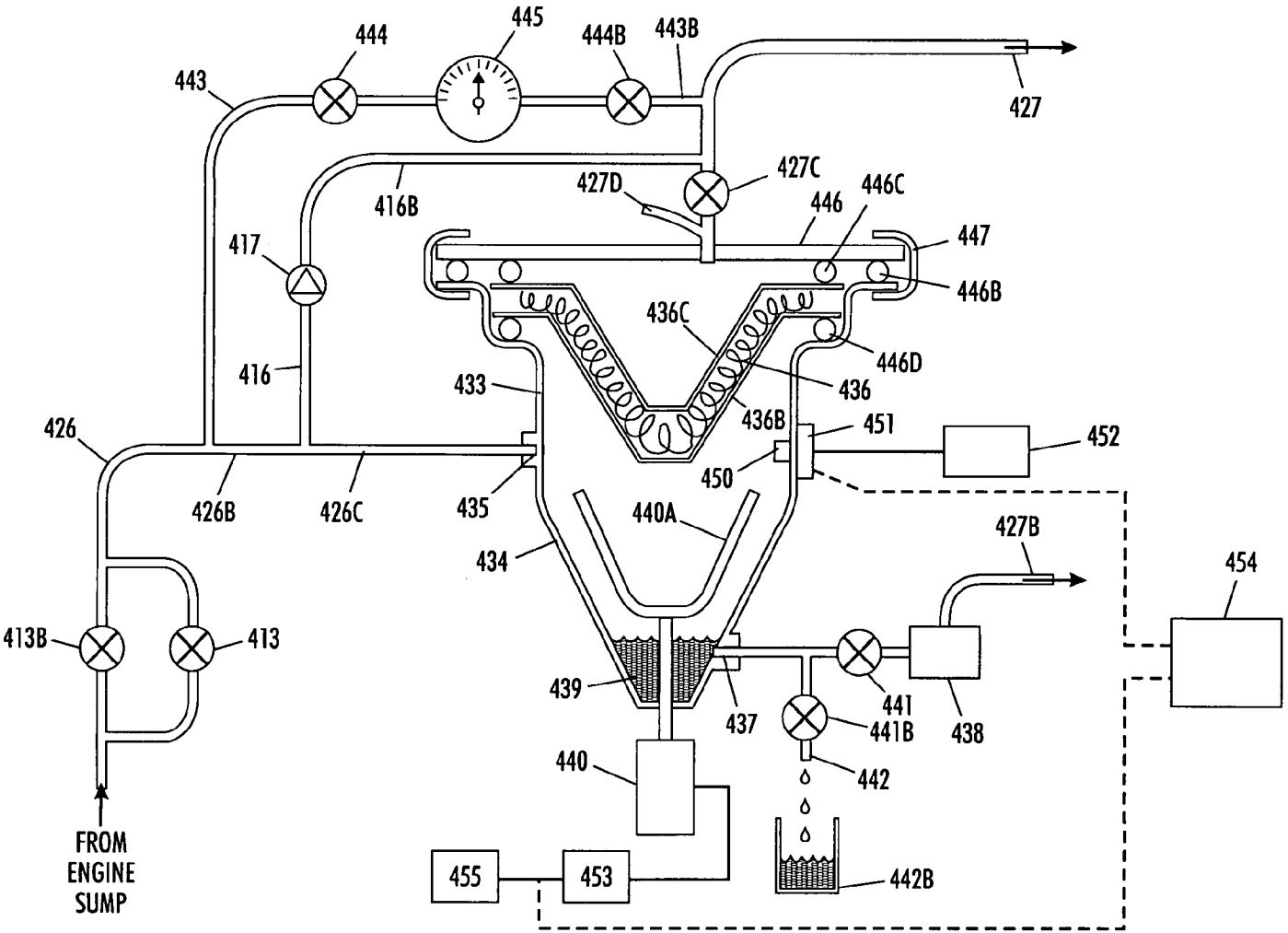
FIG. 4 is an illustrative schematic of one embodiment of a single unit containing multiple oil life extender functions according to the concepts of the present invention.

FIG. 4 is an illustrative schematic of a single unit containing multiple oil life extender functions, which enables the functions described above for FIG. 3, but with fewer parts.

Starting with the pressurized oil line from the engine crankcase, the oil flows around the closed bypass valve 413 through check valve 413B to oil line 426. Thereafter, oil flows to the filter canister 433 entering the canister tangentially at 435 where it is subjected to centrifugal force by the rotor 440A. The centrifugal action propels heavier oil components to the periphery of the canister cone 434 thence downward because of the conical shape of cone 434, thence the heavier sludge collecting in the cone bottom 434, while the lighter oil, now cleaned of heavier sludge components, rises upward through the "eye" of the centrifugal vortex, thence through the oil filter element 436.

Oil filter element 436 is held in place by metal screens 436B and 436C. Alkaline acid neutralizing chemicals, as previously described, can be incorporated into the oil filter element 436 and/or the assembly 436, 436B, 436C, so long as the chemicals are placed and/or retained on the inlet side of the oil filter element 436. This does not preclude an alternate acid neutralizing arrangement.

The concept of removable filter media illustrated in by 436, especially designed to be compressed into a small space, would be particularly advantageous. For example, a remote oil filter canister 433 with removable top 446 providing access to the removable filter 436, with the filter medium consisting of a porous high area felt, such as a fluted tube made of paper or cotton felt nested between two elements of metal mesh, could be conveniently changed and it could be frequently replaced because of the low cost of this type of filter element. An oil pressure gauge 445 between the inlet and outlet tubes of the remote oil filter would indicate the optimum time to replace the filter element, that is, when the filter back pressure increases to a predetermined value.

Filtered oil that has been de-sludged, neutralized, de-watered, and filtered thence leaves the oil filter canister 433 through the cover 446 thence to the oil return line 427, which returns to the engine crankcase and also supplies the metering process of the present invention.

The items: oil line 443, valve 444, oil pressure gauge 445, valve 444B, oil line 443B, oil line 416, check valve 417, and oil line 416B have been already explained in accordance with the description of FIG. 3.

In FIG. 4, the oil filter cover 446 is shown as attached to the outlet tube 427. This is done for clarity to show the seals of gaskets 446B, 446C, 446D, particularly as they seal the edges of the oil filter element 436. However, it is preferable to have the cover 436 free of any attachments in order to simplify service to the filter canister. The cover 436 is attached to the filter canister by a clamp 447 or a screw-threaded cover.

Returning to the sludge collection area 439, the sludge leaves the conical part 434 of the canister through line 437 to valve 441 which allows the sludge to enter the miniature positive displacement pump 438, preferably of the gear type, thence pumping the sludge via tube 427B to a retort connected to the intake manifold to recover the fuel energy.

When it is desired to change the filter element 436, bypass valve 413 is opened, which bypasses the check valve 413B to drain the filter via inlet tube 426 which only lowers the level to that of the oil filter canister inlet 435. Manual draining of the filter canister 433 to below the oil filter canister inlet 435, to fully drain the filter, or to just drain the sludge, may be done via opening the valve 441B to drain through tube 442 to a container 442B.

In another embodiment of the present invention corresponding to the embodiment illustrated in FIG. 4, after hot draining of the oil filter, air can be used to pressurize the area above the filter and thereby assist oil removal from the filter element. This is done by connecting a low volume air pump and pumping air into line 427 through an injection fitting 427D after closing a shutoff valve 427C in the line 427. The air pump connection and shutoff valve would both be located at a point along oil line 427 between the cover 446 and the intersection of oil line 427 and oil line 416B.

It is noted that the attachment of oil line 427 to the cover 446 of the canister 433 has been exaggerated to better show the o-ring and flange configuration of the cover 446. It is preferable in the actual apparatus to have line 427 enter the canister 433 rather than the cover 446, the point of entry being between the cover 446 and the oil filter element 436C. This leaves the cover 446 clean and free of inconvenient tubing and fittings.

Figure 5:
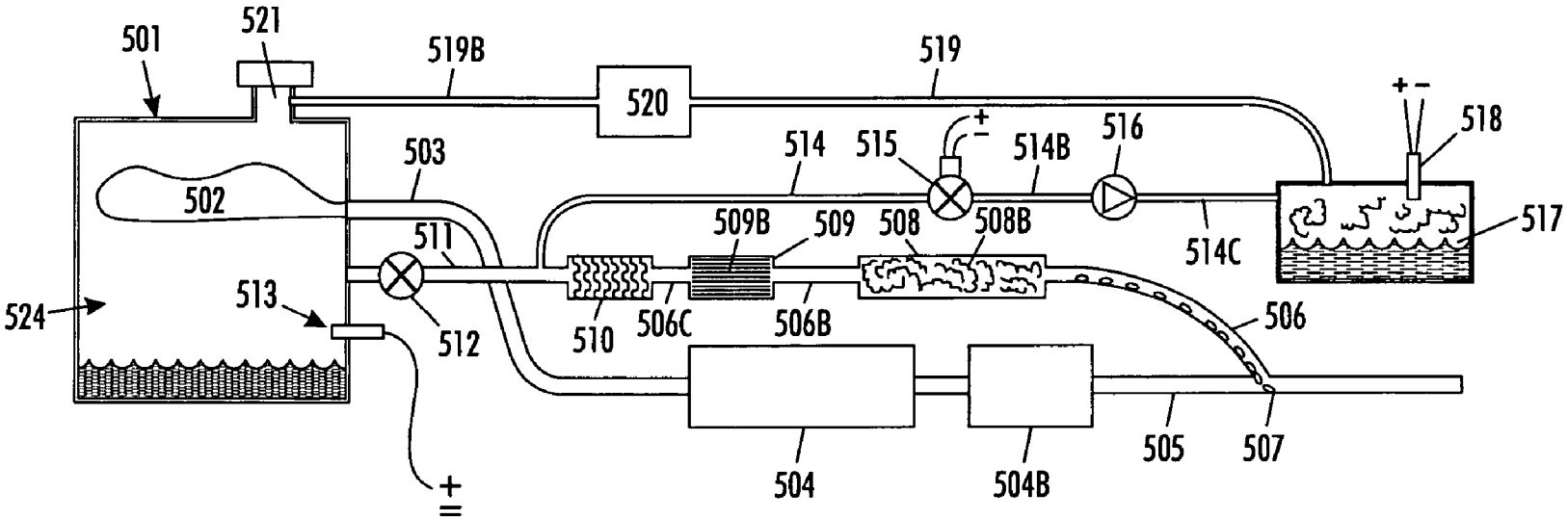
FIG. 5 is an illustrative schematic of one embodiment of an exhaust gas padding system for utilizing exhaust gas to minimize oxygen content in the crankcase and fuel tank according to the concepts of the present invention.

FIG. 5 is an illustrative schematic of an exhaust gas padding system according to the concepts of the present invention.

This system utilizes exhaust gas, which is mainly inert carbon dioxide, to minimize oxygen content in the crankcase and fuel tank. This minimizes oxidation of the oil, which can reduce oxidative oil degradation thereby reducing undesirable sludge-like components that can lengthen oil life, lengthen engine life, and reduce maintenance frequency and costs. It also reduces the chance of crankcase explosions, which are particularly hazardous in large engines due to the large crankcases with large volumes of combustible vapor in contact with high temperature and friction interaction between moving metal surfaces.

In the fuel tank, use of padding gas can reduce the fire hazard, such as from static arcs during refueling and from accidental rupture of the fuel tank.

To further explain this part of the present invention, reference is made to FIG. 5. Starting at the engine 501, exhaust gas exits to the exhaust manifold 502, thence to the exhaust pipe 503, thence to the catalytic converter 504 and sound muffler 504B, thence to the post muffler exhaust pipe 505, thence out to the environment. At point 507, near the end of the exhaust pipe 505, the following situation exists:

a. Incompletely oxidized hydrocarbons from the engine exhaust have been mainly oxidized to carbon dioxide by the preceding catalytic converter to carbon dioxide;

b. The engine exhaust contains a variety of gasses but mainly carbon dioxide, water vapor, and oxides of nitrogen and sulfur that can be acidic;

c. Exhaust gas temperature is significantly lowered compared to the engine exit temperature; and d. The exhaust gas is at a pressure higher than atmospheric.

At point 507, the exhaust gas under pressure is tapped into tube 506, which tube is angled upward toward the engine 501. The exhaust gas flow rate through this tube is low, thus the heat capacity of this small amount of gas is low. So, the gas is quickly cooled by tube 506 via conduction of the heat to the surrounding air. The result is, water vapor in the exhaust condenses into liquid water 507 which flows down tube 506 into exhaust pipe 505 in which the liquid water is carried out with the main exhaust.

However, adding chamber 508 into the system, which chamber has a corrosion resistant packing 508B, such as stainless steel wool for example (but not limited to this material) results in the water vapor condensing onto the packing, making the packing behave like a sticky filter, which not only removes water but captures exhaust gas particles, which can flow out tube 506 out along with the condensed water. The cooled, filtered, de-watered exhaust gas continues through tube 506B into the acid neutralizing canister 509, in which the alkaline components 509B neutralize the acid components, such as oxides of sulfur and nitrogen, and the alkaline chemicals also have some drying capacity to further dry the exhaust gas, and the contents of this canister also have some particle removing capability.

Preferred materials for the acid neutralizing canister would be a carbonate type compound, for example of calcium, sodium, and magnesium, singly, or in combination, but not necessarily limited to these specific examples. Carbonates are preferred over hydroxides and oxides because these latter alkaline forms would react with the carbon dioxide of the exhaust gas, thereby lowering carbon dioxide content and possibly swelling and/or damaging the alkaline canister.

Following the neutralizing canister 509, the exhaust gas goes through tube 506C to a final fine-particle filter 510, although it is unlikely that any particles are still suspended in the exhaust gas at this point, therefore this filter would be expected to have a very long service life. In the case of a diesel engine exhaust, significant amounts of fine soot may be in the initial engine exhaust, therefore the final filter should be larger and the filter element pore sizes smaller than for a gasoline engine. But again, the conditions and the process prior to this final filter make it likely that most particles will have settled out prior to filter 510.

At this point in the process, there now exists inert carbon dioxide gas, mainly free of acid, water, and particulates, such gas under pressure and now being suitable to be used for addition to the engine crankcase and the fuel tank.

After leaving filters 509 and 510, the purified exhaust gas travels through tube 511, thence through the control valve 512, thence into the engine crankcase 524. Adding the gas at a pressure slightly above what normally exists in the crankcase sweeps oxygen-containing air out of the crankcase and keeps oxygen from coming into the crankcase. It is noted that normal crankcase pressure may be negative, thus pressure higher than negative may still be negative pressure overall. It is important that external air not be permitted into the crankcase; only purified exhaust gas is intended.

The amount of gas injected into the crankcase can be regulated by the automatic valve 512 controlled with the sensor 513, or it may be manually set to maintain the ranged of desired pressure in the crankcase. It is pointed out that desired pressure in the crankcase may be equal, higher, or lower than atmospheric depending upon the specific engine, but in any event, the exhaust gas input to the crankcase must be sufficient to minimize residual oxygen in the crankcase when the engine is running.

Regarding injecting exhaust gas into the fuel tank, reference is made to the purified exhaust gas line 511, from whence a tap provides purified exhaust gas to line 514, thence through automatic control valve 515, which regulates the amount and/or pressure of exhaust gas by sensor 518 in the fuel tank 517. From automatic control valve 515, the purified exhaust gas goes through tube 514B to one-way valve 516 (the one-way action preventing backflow of fuel or fumes) thence to the fuel tank.

Also, regarding injection of carbon dioxide into the crankcase, it is recognized that carbon dioxide could react with water in the crankcase oil to form carbonic acid. However, carbonic acid formation is unlikely, because carbonic acid is formed in cold water whereas the high temperature of the crankcase would most likely prevent this reaction to any significant extent. In any event, means have already been provided to reduce water in the crankcase oil and further means are provided in subsequent description.

In addition to these water removal methods, a further water removal device is provided, which will be fully described below in connection with FIGS. 6 and 7.

In short, this embodiment of the present invention can operate by continually metering a small portion of oil (using the metering technology previously described) into a small chamber maintained at about 240 degrees Fahrenheit to vaporize water but not the oil. The chamber has an oil drain connected to the crankcase of the engine, and a vapor tube, under vacuum, connected to the top of the chamber to carry off water vapor and gasoline vapor to the intake manifold of the engine. The heat can be mainly supplied by running the oil line next to the exhaust manifold, or by surrounding the line with hot engine coolant through a chamber supplied with hot engine coolant, with final temperature level controlled by supplemental heat from a thermostat controlled electric coil.

As to the existence of water in the first place, the water content in the oil using the present invention would be less than conventional systems without the present invention because the present invention is continually consuming crankcase oil and the water carried in it, whereas conventional systems keep all the water in the crankcase until the 3000 mile oil change service replaces the entire amount of oil.

Figure 6:
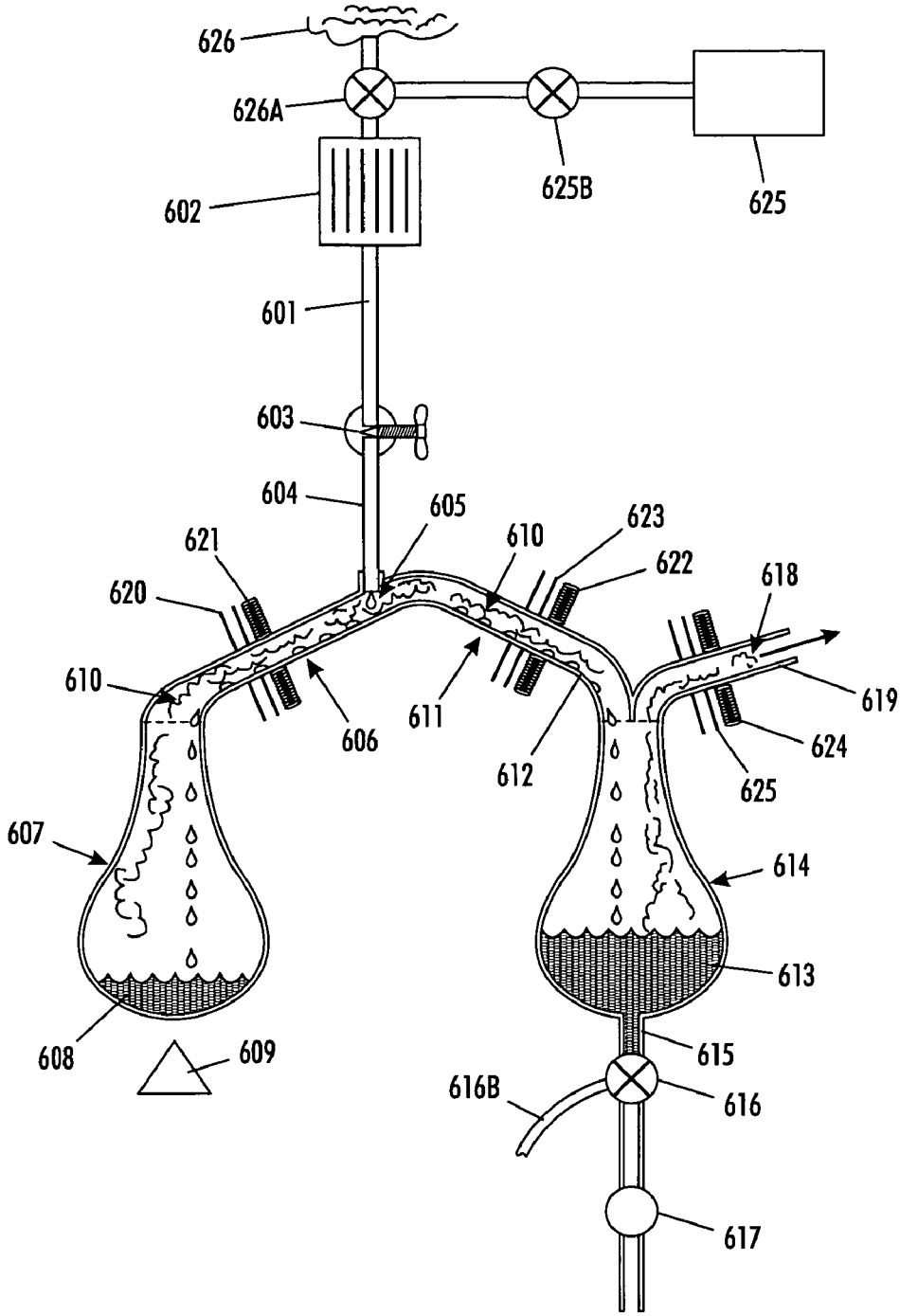
FIG. 6 is an illustrative schematic of one embodiment of a retort according to the concepts of the present invention.

FIG. 6 is an illustrative schematic of another embodiment of the present invention which may be used alone or in any logical and desirable combination with any other aspect of the present invention to achieve desired end goals when operating under the many variation of climate and operational conditions.

Starting with a source of oil to be processed, the oil would normally be used oil coming from a crankcase 626 of a specific engine, but it could be mineral based engine oil from most any engine, and/or it could be an acceptable non-mineral based oil. Alternatively, the oil to be processed could be received from an auxiliary tank 625 through valves 625B and 626A.

Oil, under pump pressure or gravity pressure from crankcase 626 thence goes through valve 626A to oil filter 602 then through oil filter outlet line 601 thence to the metering valve 603 then through drip tube 604 to supply the desired number of oil drops 605 into the ascending-retort-vapor-tube 606. Heat in this area immediately starts to vaporize gasoline and water out of the oil drops, which vapors start to travel into the descending vapor tube 611.

This partial vaporization occurs because crankcase oil is a complex mixture of many components that have different boiling and vaporization properties.

The portion of oil that did not immediately vaporize drains progressively down the ascending-retort-vapor tube where it encounters hotter and hotter temperatures with each component vaporizing as it encounters its corresponding vaporization temperature, with the vapors traveling up the ascending-retort-vapor-tube into the descending vapor tube.

Heavy oil, sludge, and other components that are not vaporized, flow down into the retort bottom 608. The retort is preferably embedded into the high temperature exhaust gas manifold and uses the exhaust gas heat 609, to pyrolyze the heavy hydrocarbons. Although the Retort is preferably located on the exhaust manifold, it can be located on the exhaust pipe with proximity to pipe and engine manifold plus insulation. The result is that the undesirable high molecular weight non-volatile sludge materials 608 are heat converted into lower molecular weight vapors, which then travel out of the retort and ultimately to the engine combustion process where they are utilized as desirable gaseous fuel in the engine.

Since most abrasive particles do not vaporize but stay in the retort, the present invention is the only on-board process that can remove all abrasive particles from used engine oil, including those small but still abrasive particles that go through most engine air filters and oil filters. This is particularly beneficial because abrasive particles can wear out any engine.

Another very important benefit from the process, thus described, is that oil components that are in a pre-sludge condition are removed from the oil before they form sludge and engine coating deposits inside the engine.

To explain this further, engine chemistry converts crankcase components into compounds different than when originally added to the crankcase. With time and the temperature in the crankcase, these changed compounds start to form sludge. If the temperature is increased, the changed compounds form sludge and varnish sooner. When the retort portion of the present invention subjects the oil to a higher temperature than in the crankcase, the sludge and varnish react to form heavy hydrocarbons that do not readily volatilize but instead travel farther down into the retort and are effectively removed by the present invention before they cause trouble in the crankcase. The oil vapors, from the oil portion so processed, are now effectively cleansed of compounds ready to form sludges and varnishes; the vapors are effectively cooled and the oil is condensed back to liquid oil that returns to the temperature of the crankcase when returned to the crankcase.

The vapors 610, which are hot, escape upward through the ascending-retort-vapor-tube 606 into the cooler descending-vapor-tube 611, with temperature controlled to above about 240 degrees Fahrenheit, which temperature results in the oil vapor condensing into clean liquid oil drops 612, which accumulate as clean oil 613 in the separation chamber 614. At the same time, the temperature is maintained high enough to keep gasoline and other fuel vapors and water in vapor form 618, in which form they travel through the outgoing-vapor-tube 619 to the intake manifold of the engine, where gasoline and fuel vapors are consumed as fuel and the water vapor can result in a small but desirable combustion effect analogous to adding high value octane to the gasoline.

The separation chamber 614 may be configured as a collecting space from which oil slowly drains back into the engine crankcase from tube 615, or the oil may be pumped by a miniature positive displacement pump 617, the pump preferably of the gear type, to wherever desired, or it may be configured as a collection tank to be emptied via tube 615 and 3-way valve 616 and tube 616B and utilized as desired. At the same time, non-condensed vapors 618, consisting largely of gasoline, other fuel vapors, and water, continue in vapor form to the intake manifold of the engine.

Separation of lubricant oil from gasoline, other fuel vapors, and water, is accomplished by temperature control in the vapor tubes 606, 611, and 619, and the separation chamber 614 with ascending-retort-vapor-tube 606 kept above about 550 degrees Fahrenheit to keep all components vaporized. The area of the ascending-retort-vapor-tube 606, where waste oil drops 605 enter, immediately vaporizes the lower boiling point components, like gasoline. In the direction towards the retort, the temperature progressively increases, thus progressively vaporizing the components according to their increasing boiling point characteristics. This means that components that can vaporize at lower temperature do so without being subjected to higher than necessary temperatures that might unnecessarily degrade the component.

When the vapors travel beyond the arch between the ascending-retort-vapor-tube 606 and the descending-vapor-tube 611, the temperature is decreased to condense out the lubricant oils but the temperature in the descending-vapor-tube 611 and the separating chamber 614 is maintained to above about 240 degrees Fahrenheit to keep the gasoline, fuel vapors, and water in vapor form, the vapors thence to be fed to the intake manifold and combustion process.

In another embodiment of the present invention, the present invention can continually treat a portion of any crankcase oil for the purpose of vaporizing gasoline and water contaminants while returning the remainder of the crankcase oil back to the crankcase. In this embodiment, if one uses an apparatus consisting of only the right side portion of the apparatus shown in FIG. 6, that is that portion from the apex of the arched vapor where the arched vapor tube travels downward towards the separation chamber 614 (the apparatus would consist of components 610, 611, 612, 613, 614, 615, 616, 616B, 617, 618, 619, 624, and 625), then if crankcase oil is dripped into this lower-temperature-controlled portion (about 240 degrees Fahrenheit), lubricating oil will not be vaporized but gasoline contaminant and water will, and these contaminants can be vacuumed out to the engine air-fuel intake manifold.

Furthermore, drops of crankcase oil must be dropped into the beginning portion of the descending vapor tube 611. This can be done with apparatus identical to that used to drip drops of crankcase oil into ascending vapor tube 606. The identical parts of the drip apparatus consist of components 626, 602, 601, 603, 604, and 605. (For simplicity, the crankcase oil drops 605 and the condensed oil drops 611 were listed as apparatus components though it is realized that these are not apparatus components but rather material components; the same is true for liquid oil 613 and vapors 610 and 618).

Temperature and temperature profile management of the system starts with the heat from the retort, thence transmitted by thermal conduction by the metal of the apparatus, and by heat transmitted by heated mass of the vapors, and by heat preserved by insulation, with supplementary as-needed-heat capability, such as electrical, or heated engine coolant represented by features 621, 622, 624 on the vapor tubes 606, 611, and 619. Cooling, as needed, to lower temperature, is accomplished by original design and proximity to heating and/or airflow, by decreasing insulation, and by increasing apparatus length and area to increase ambient cooling represented by cooling fins 620, 623, and 625.

What has been accomplished here is a distillation process, which boils off the volatile portions of the used crankcase oil, after which the high quality lubricating oil is separated from the gasoline and water contaminants by the temperature difference in the descending vapor tube. The oil that collects in separating chamber 614 is a high quality lubricant. It can be used as is in an engine crankcase, or alternatively, it might be mixed with additives, and then reused.

As previously noted, vapors of gasoline and water have been removed and fed to a combustion process. Additional accomplishments include: removal from the oil of acid content, removal of sludges, removal of pre-sludges, removal of abrasives that have already passed through the oil filter and contribute to engine wear with the powder residue remaining in the retort but removable via cover removal on the retort, conversion of waste hydrocarbons into fuel heat, exhaust gas heat has been used to power this onboard refinery thus the energy needed to recycle this oil at an traditional oil refinery is no longer needed. Refined oil collected from this part of the present invention can be utilized as is, or modified as desired with additives, then used in the engine as needed, or used in a different engine.

FIG. 6 is additionally representative of an alternative embodiment of the present invention, the difference being that the crankcase oil 601 is supplied from filter 602 from a container 625 filled with waste oil from a source outside the vehicle rather than from the engine crankcase of the vehicle in which the present invention is installed. The refined oil would be collected in the separation chamber 614. This would be particularly applicable in large trucks that have ample space and ample exhaust heat in the engine compartment. One large truck could process used oil from several smaller trucks.

In a further modified embodiment, waste oil 601 from the engine filter 602, or from a different source fed from a supply tank is converted entirely to fuel vapors in the retort 607, which vapors are consumed as fuel energy in the engine. This conversion is done by high temperature breakdown of high molecular weight oil into lower molecular weight fuels producing vapors that can be efficiently burned in a gasoline or diesel engine. The action takes place by containing and continually subjecting the waste oil to the very high temperature in the retort 607.

The containment to the retort is accomplished by cooling the ascending-vapor-tube 611 (using coolant such as ambient air, including fins such as 621 and/or engine coolant) to a temperature low enough to repeatedly condense out the high boiling point oils back to the retort until they break down to lower boiling point fuels. Adjuncts to facilitate the waste oil conversion include, mechanical obstruction to vapor flow in the retort such as baffles and metal coils, catalysts, and air injection to effect partial oxidation and sweep vapors toward the engine intake manifold.

The ascending vapor tube of this embodiment connects to the intake manifold of the engine without the need for the descending vapor tube 611 or the associated components that follow it. This embodiment enables conversion of oils not normally consumed as engine fuel to be converted to engine fuel. French fry oil is an illustration of what might be used such as for a diesel fuel extender (although some pre-treatment of this particular oil or other vegetable oils may be needed to attain desired performance with the present invention; use of such vegetable oil in combination with one or more adjunct materials, such as diesel fuel, may also be desirable).

Figure 7:
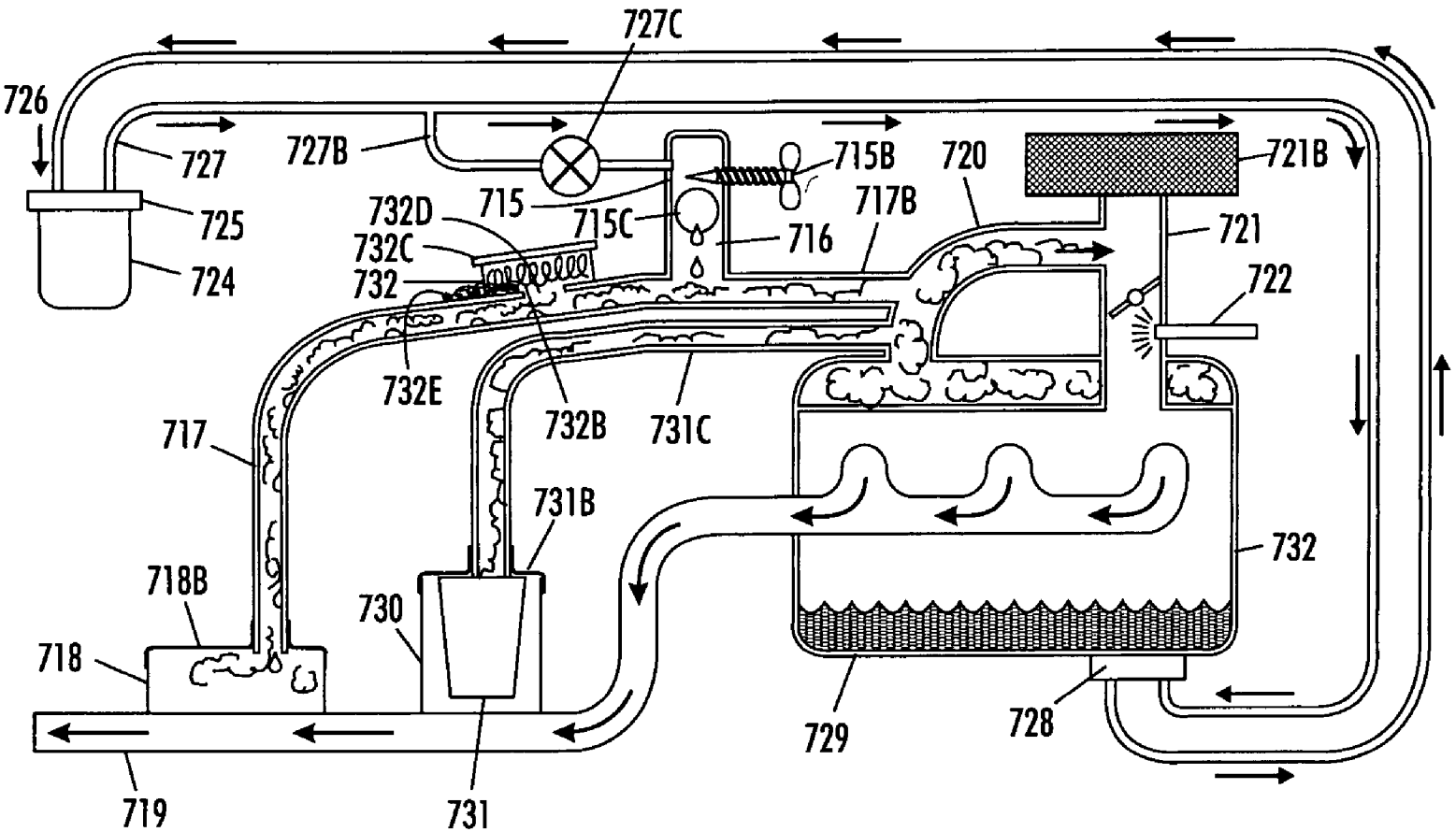
FIG. 7 is an illustrative schematic of another embodiment of a retort according to the concepts of the present invention.

FIG. 7 illustrates an example of a layout of the components when the present invention is installed in an automotive or diesel engine. FIG. 7 is meant to be illustrative rather than restrictive unless otherwise stated, for example, it is recognized item 722, indicating fuel atomization below a butterfly valve, is not where most fuel is injected in a diesel engine, but it is representative for a gasoline engine and for situations where additional fuels, oils, or solvents may be introduced.

To explain the illustration, crankcase oil 729 is piped through the oil filter adapter 728 via tube 726 to the remote filter adapter 725 and filtered by oil filter 724 thence out by tubing 727 to 727B tap which provides filtered and pressured oil flowing through an automatic on-off valve 727C (which is turned on when temperature reaches a preset level such as 190 degrees Fahrenheit and engine speed is significantly above idle). Thereafter, the oil flows into the orifice of 715 controlled by needle valve 715B to enable oil drops, counted per unit of time through observation port 715C, the resulting oil drops 716 entering the hot ascending-vapor-tube 717 having a surface temperature gradient. It is noted that the hot ascending-vapor-tube 717 may be a corrugated tube so as to provide the surface temperature gradient.

The low boiling components of the drops, such as gasoline and water, start to evaporate as the drops encounter the surface temperature gradient, with the higher boiling components migrating down the ascending-vapor-tube 717, where the higher boiling point components progressively vaporize as they encounter the higher temperatures toward the retort 718. The remainder of the drops descend into the retort 718 where they are vaporized thence travel upward through 717 and temperature controlled 717B at about 550 degrees Fahrenheit or higher to keep all materials in vapor form thence into the temperature controlled separation chamber area 720, controlled to about 240 degrees Fahrenheit to condense oil vapor back to the crankcase and at the same time allow fuel and water vapors to remain in vapor form. The fuel and water vapor travel into the crankcase vapor control system at a point close to where they can be scavenged by engine vacuum into the engine's intake manifold system 721, the entry point just prior to fuel entry or fuel injection 722.

Referring back to where oil drops 716 enter ascending-vapor-tube 717, it is noted that the vaporization can start close to where lubricant oil can be condensed back to the crankcase and the fuel vapors can enter the intake manifold system of the engine. The value of this configuration is that it is desirable to vaporize the crankcase oil first, at a temperature not excessively greater than the minimum needed, and secondly to minimize the time the oil is subjected to the vaporizing temperature, which is done by minimizing the distance from the point of oil vaporization to the entry of the vapor control system of the engine. Limiting temperature and exposure of the lubricant oil only to what is needed minimizes oil degradation.

The temperature in the region where the oil drops 716 enter the ascending-vapor-tube 717 needs to be high enough to vaporize the major desirable components of the motor oil being used. Higher temperatures may be needed for synthetic oils than for standard petroleum based motor oils.

For most applications, the heat in the ascending-vapor-tube 717 comes from thermal conduction from the retort 718 and the heat in the mass of upward flowing vapor flow. The heat for the retort, which is an integral part of the exhaust manifold casting 719, comes via metal conduction from the hot exhaust gasses. The hottest part is at the retort 718; the coolest part where the vapor tube 717B enters the engine separation chamber area 720, which is combined with the engine's vapor control system. Temperatures in 717, 717B, and 720 are controlled by insulation to preserve heat, or cooling fins to lower temperature, and/or electrically controlled coils for supplementary heating.

The area where 717B meets 720 is slightly higher in elevation than the area where the oil drops 716 enter the ascending vapor tube 717. This difference in elevation is important in order to prevent unprocessed liquid oil from entering the engine's vapor control system.

In the operation of the present invention, oil drops 716 that do not immediately vaporize upon entering vapor tube 717 travel downward into the hotter portion of the vapor tube 717 where they vaporize and are recovered as high boiling components of oil returned to the engine crankcase. Oil that does not vaporize, such as sludge components, travels further downward in the ascending vapor tube 717 into the highest temperature zone of the system, which is the retort 718 (with removable lid 718B for cleaning ash residue). The temperature there breaks down the sludges into fuel vapors that travel out through the ascending-vapor-tube 717 and 717B to the separation chamber 720 combined with the crankcase vapor system thence into the engine air intake 721 to be consumed as fuel. For clarification, the engine's air filter is shown as 721B.

The present invention recovers useable lubricant and extracts available fuel energy from an engine's used oil filter. Referring to FIG. 7, the used oil filter 731, hot drained of excess oil, is inserted into the retort 730 (which has a removable lid 731B). Recoverable lubricant and fuel vapors are distilled out of the unit, by the processes previously described, with the vapors traveling up the vapor tube 731C and entering the oil vapor control system 720, where they are utilized by the processes previously described. After the mainly liquid components in the retort 730 are distilled out, the temperature in retort 730 will elevate and all of the useable residues will be baked out and utilized and/or consumed by the processes previously described. Even the filter element itself can be pyrolyzed and consumed as fuel vapor. For this configuration, the parts in FIG. 7, labeled 732, 732B, 732C, 732D, and 732E would not be needed.

A removable filter medium, such as a fluted paper element (like a heavy duty coffee filter), is particularly desirable because when compressed, the space required for the retort would be substantially smaller than required for an oil canister. In vehicles where the engine compartment space is congested and access to the exhaust system is difficult, needing only a small space to process oil filter waste means that a compressed oil filter medium could be inserted in a pocket at the top of the vapor tube used to process only crankcase oil. Referring to FIG. 7, this is illustrated by pocket 732, with removable filter element 732B being processed, having insertion door 732C and receiving heat from vapor tube 717. The vapor enters this tube via port 732D. The pocket 732 receives supplemental electric heat via heating coil 732E.

The area around 732E of the vapor tube 717 would not normally be hot enough to pyrolyze the filter medium or vaporize all of its sludges, but it would be hot enough to recover the extractable lubricant leaving only a small fraction of the environmental waste currently presented by waste oil filters. However, supplemental electric heating via coil 732E to the filter-processing pocket 732 could further reduce even that small fraction.

This tubular configuration of the present invention, side pocket, with as-needed insulation and/or supplemental heat, facilitates installation into tight irregular spaces, thus allowing nearly all vehicles to be equipped with its benefits.

Alternatively, the removable paper type filter element could be washed with gasoline or diesel oil solvent, and the extract filtered and blended into the fuel tank. The solvent in the paper filter could then be extracted in a small canister connected to a vacuum line leading to the engine intake manifold.

As noted above, many modifications of the present invention can be realized without departing from the spirit or scope intended by the concepts of the present invention. For example, it is contemplated by the present invention that the crankcase oils used in conjunction with the present invention may be formulated to provide equal or better engine lubrication and at the same time improve the combustion efficiency of crankcase oil fed to the engine's fuel system.

The present invention also contemplates the use of synthetic oil. With synthetic oil, the oil will realize a longer crankcase life than non-synthetic crankcase oils, thus synthetic oil does not have to be changed as frequently, thereby reducing the rate of burning and processing of the used crankcase oil in the combustion process.

As noted above, further reductions in the rate of feeding oil to the combustion process can be achieved by taking steps to preserve crankcase oil quality so that it does not have to be replaced so often. The steps are: (a) maintain low acidity by neutralizing and/or removing corrosive combustion acids which are a prime cause of engine wear-out; (b) maintain oil filter efficiency by monitoring filter back pressure so that the filter does not plug thereby causing the filter bypass valve to open which completely defeats the purpose of the filter and worse can flush abrasive sludge into the engine oil system; (c) maintain oil filter efficiency by pre-filter procedures to remove sludge from the oil before it plugs the filter pores; which extends the useful life of the filter and enables the use of smaller pored filters to further remove smaller abrasives while maintaining oil flow throughput. Lastly, one can maintain oil viscosity by monitoring manually or with a simple dashboard readout viscosity meter to enable the selection of using higher or lower viscosity replacement oil, as indicated.

The present invention, by utilizing waste engine heat not currently utilized by any other use, can overcome many of the problems associated with conventional methods. More specifically, when the method of the present invention is compared to a conventional 3000-mile oil change cycle, the oil quality in the present invention's system does not degrade to the 3000-mile quality because it is continuously being refined. Moreover, when the present invention is set to do a complete refining in 3000 miles, the oil quality maintained in the present invention's system is comparable to 1500-mile usage oil in a conventional system, which is considered high quality. When makeup oil is taken into consideration plus oil filter processes of the present invention, the quality of the oil in the present invention would be expected to be better than the 1500-mile oil of the conventional system.

A further concept of the present invention is the utilization of oil formulated to minimize additive depletion by selecting from available additives and developing new ones that vaporize in the same temperature range as the lubricating oil components of the used crankcase oil, thus additives would be recovered along with the lubricating oil.

One benefit of the present invention realized from the retort action is the acceleration of the thermal polymerization of crankcase components ready to form troublesome sludges, gels, and varnishes. The result is the sludges, gels, and varnishes do not vaporize, thus they are removed from the used crankcase oil before causing troublesome deposits inside the engine.

In a preferred embodiment of the present invention, no other energy expenditure is required because the present invention harnesses the normally wasted heat energy of the engine's exhaust system. However, this is not to preclude use of any other energy from the engine; examples being, but not limited to, hot liquid from the engine's cooling system, high temperature liquids, high temperature gasses, vacuum sources, vacuum motors, hydraulic pressure, air and liquid pressure, electrical energy for control and heating, devices powered by air from cooling fan and/or vehicle motion or exhaust pressure.

Most of the above examples of the present invention refer to automotive gasoline engines and diesel truck engines but it is pointed out that the concepts of the present invention are readily applicable to nearly all engines that generate waste oil and/or heat; examples being, but not limited to: train locomotives, generator engines, farm tractors, pump engines, ship engines, and lawnmower engines.

In engines utilizing the present invention, changes may be made in various operating parameters to enhance efficiency of the entire process. Some of the changes would include, but are not be limited to, the following: (a) the fuel-air intake manifold could be partially insulated to preserve fuel vaporizing heat; (b) the manifold may be heated with hot engine coolant to improve fuel vaporizing; (c) the compression ratio of the engine may be raised to improve combustion efficiency of the added crankcase oil fuel; (d) crankcase oil reformulation may be desirable to increase the percentage of lower viscosity/lower boiling lubricating oils to improve their combustion efficiency when utilized for fuel; (e) fuel reformulation may be desirable to increase the oxygenated components of the fuel to improve combustion efficiency when crankcase oil is added to the fuel; and/or (f) synthetic oils may be substituted in the crankcase oil, thus increasing the useful mileage life of the crankcase oil, and thereby reducing the rate at which the used crankcase oil needs to be consumed by the combustion process.

Furthermore, the present invention may include an auxiliary system that injects oxygenated fuel to reduce air pollution when the engine idles, anti-knock liquids to improve engine performance when the engine is under load, and combustion catalysts into the fuel line along with the oil being burned to obtain full energy recovery from the waste oil being burned and which can facilitate cold engine starts under cold climatic conditions.

In the various descriptions of the present invention, the conduits that transport the oil and vapors may be conventional fuel or vapor lines. Moreover, the conduits that transport the oil and vapors may also include various valves and/or filters to control the quantity and quality of transported material.

In situations where the oil is treated by the present invention to neutralize acidity and to remove water contaminant, remove gasoline contaminants, sludge, and fine particles, the oil may not need to be burned in 3000 miles, but rather it can be used as long as the proper viscosity is maintained. In general, the only requirement would be to add fresh makeup oil for oil burned in the combustion chamber. But if an engine is so efficient that little makeup oil is rarely needed, a check of the oil viscosity may be desired from time to time.

The present invention contemplates providing a valve in the outlet line from the oil filter to obtain a filtered oil sample. A simple viscosity testing device would be made available, in the form of a cup, with a thermometer, an orifice, and a valve, to enable collecting a cup of oil, thence opening the valve and letting the oil flow out the orifice into an oil addition port of the engine and timing the seconds for the cup to empty. If too slow, one would switch to the next lower grade in viscosity for the makeup oil; if the oil runs out too fast, the next higher viscosity grade would be used. A time-temperature-viscosity chart would be provided to interpret the test results for oil selection.

It is noted, as illustrated in FIG. 4, that an amperage reading off the centrifuge motor by an amperage reading unit 453 in combination with an amperage display unit 455, plus an embedded thermometer 450 with a temperature reading-sending unit 451, which provides data to a temperature display unit 452, and a amperage/temperature chart could be used to provide a viscosity reading, thus no need for a stand-alone viscosity measurement unit.

FIG. 4 further illustrates a viscosity measurement/display unit 454, which receives temperature data from the temperature reading-sending unit 451 and amperage data from the amperage-reading unit 453, calculates an oil viscosity based on the received data, and displays the oil viscosity measurement.

A viscosity check is necessary when oil is used for long periods because two opposite changes can occur in the oil: (1) the oil can break down into smaller molecules which lower oil viscosity, thus makeup oil needs to be of a heavier weight; and (2) at high temperatures, the smaller molecules can evaporate leaving the large high viscosity molecules behind, thus makeup oil may need to be of lower viscosity.

A remote viscosity measurement device may be devised as follows: a) from the filtered oil line leading to the needle valve of the present invention, b) a tap is made; c) a tube is attached which conducts tapped oil through a small supply line to d) a chamber, with e) an overflow port leading to the engine crankcase; f) a disk powered by a small electric motor is rotated in the chamber with the current sent to g) a meter on the vehicle dash and the h) temperature of the oil taken by a transmitting thermometer. The current reading vs. the temperature is converted to reveal the oil viscosity.

When oil is treated such that it may be used for long periods without replacement, it is particularly desirable to assure that the filter is not used too long otherwise the filter may clog causing the bypass valve to open, the oil to bypass the filter, and dirty oil to be sent back to the engine. To assure that the oil filter is not used too long, or changed before necessary, or that the oil filter element is torn and passing unfiltered oil, the present invention utilizes oil pressure gauges on the inlet and outlet of the filter to properly determine when the filter must be changed.

As noted above, the present invention contemplates water removal from the oil. A preferred embodiment of the present invention for water removal consists of a heated tube (heated to about 220 to 240 degrees Fahrenheit) to remove water and gasoline from the oil, with the treated oil being fed back to the crankcase sump. A portion of the oil is continually treated with this device to boil out the water and fuel vapors that are sent to the air fuel intake manifold while the remaining oil is sent to the crankcase. Since the amounts of water and gasoline in the oil at any given time are small, the amount of oil treated at any given time needs to be only a small portion of the total oil, thus the temperature of the bulk of the oil is relatively unaffected even though the oil temperature of the treated portion may be higher than the temperature of the bulk of the oil.

A further embodiment of the present invention is an automatic oil feed system. This system consists of a small sump chamber, connected to the engine crankcase by a tube, whose small size and shape constrict the flow rate between the two sumps, thus rapid and continual fluctuations in oil level due to engine forces will be evened out to provide an accurate representation of crankcase oil level by the level in the small sump chamber.

A float inside the small sump chamber can be used to open or shut a small orifice connected to a supply of fresh oil, thus slowly admitting fresh oil when the level of oil in the small sump chamber drops due to a drop in the effective oil level of the engine crankcase. The oil may be gravity fed from an auxiliary tank.

A pressure equalizing connection air tube could be provided to connect the crankcase air chamber to the air chamber of the small sump chamber and to the oil supply tank. If for any reason a gravity-feed auxiliary oil tank is impractical, oil could alternately be supplied to the small chamber sump to keep its level nearly constant, by a small positive displacement pump, according to a level sensor in the small chamber sump.

In summary, the present invention can eliminate vehicle oil changes, reduce the amount of crude oil needed and consequently reduce the level of need for imported crude oil, eliminate associated oil change costs and inconvenience, eliminate associated environmental waste, eliminate dribbling oil and waste of oil energy in used oil filters, and can recover the fuel benefit of waste oil discarded to the environment.

The present invention further provides methodology and an engine-mounted apparatus to refine the crankcase oil of the engine and the oil filter waste into high quality recycled crankcase oil and/or into fuel for the engine, thereby nearly eliminating the environmental problems resulting from waste engine oil and oil filters.

The present invention additionally provides means for extending oil life and means for improving engine life, both attributes of which additionally reduce associated pollution and energy costs. The present invention improves vehicle safety by replacing the oxygen in the crankcase and vehicle fuel tank with purified exhaust gas, of which the main component is carbon dioxide.

While various examples and embodiments of the present invention have been shown and described, it will be appreciated by those skilled in the art that the spirit and scope of the present invention are not limited to the specific description and drawings herein, but extend to various modifications and changes all as set forth in the following claims.

What is claimed is:

1. A vehicle mounted oil recovery system, comprising:

a retort system, mounted upon the vehicle and operatively connected to receive oil, to pyrolyze and distill the oil into vaporized components;

said retort system including a sloping tube and a retort chamber;

said sloping tube having a first end and a second end such that the oil drains progressively down from said first end to said second end, said second end being connected to said retort chamber, said first end receiving the oil, said first end providing an exit for the vaporized components such that the vaporized components flow from said retort chamber and said second end to said first end;

said sloping tube having a surface temperature gradient, a surface temperature associated with said first end being less than a surface temperature associated with said second end.

2. The vehicle mounted oil recovery system as claimed in claim 1, further comprising:

a conduit, operatively connected to said first end of said sloping tube, to convey the vaporized components to a fuel-air system of the vehicle for combustion thereof.

3. The vehicle mounted oil recovery system as claimed in claim 1, further comprising:

a conduit, operatively connected to said first end of said sloping tube, to convey the vaporized components to a fuel-air system of the vehicle for combustion thereof;

said retort system including a temperature controlled chamber, operatively connected to said conduit, to provide supplemental heat so as to maintain a portion of the vaporized components vaporized, said portion of the vaporized components being conveyed by said conduit.

4. The vehicle mounted oil recovery system as claimed in claim 3, further comprising:

a cyclonic/centrifugal sludge remover to remove sludge and water from the oil; and a second conduit to convey the removed sludge and water to said retort system.

5. The vehicle mounted oil recovery system as claimed in claim 3, wherein said retort chamber is mounted directly upon an exhaust system of the vehicle, said retort chamber capturing heat from the exhaust system of the vehicle to provide energy to pyrolyze the oil into vaporized components.

6. The vehicle mounted oil recovery system as claimed in claim 1, wherein said retort chamber is mounted directly upon an exhaust system of the vehicle, said retort chamber capturing heat from the exhaust system of the vehicle to provide energy to pyrolyze and distill the oil into vaporized components.

7. The vehicle mounted oil recovery system as claimed in claim 1, further comprising an active heating device operatively connected to said retort chamber so as to provide energy to said retort chamber to pyrolyze and distill the oil into vaporized components.

8. The vehicle mounted oil recovery system as claimed in claim 1, further comprising:

a cyclonic/centrifugal sludge remover to remove sludge and water from the oil; and a conduit to convey the removed sludge and water to said retort system.

9. The vehicle mounted oil recovery system as claimed in claim 1, wherein said retort system includes a heating apparatus to provide supplemental heat so as to maintain a portion of the vaporized components vaporized.

10. The vehicle mounted oil recovery system as claimed in claim 1, wherein said retort system includes a cooling apparatus to provide cooling so as to condense a portion of the vaporized components.

11. The vehicle mounted oil recovery system as claimed in claim 1, wherein said retort system further includes:

an additional sloping tube;

said additional sloping tube having a first end and a second end such that a slope from said first end to said second end is downward;

said first end of said sloping tube and said first end of said additional sloping tube being connected;

a first controllable supplemental heat source to provide supplemental heat to said sloping tube so as to maintain a portion of the vaporized components vaporized; and a second controllable supplemental heat source to provide supplemental heat to said additional sloping tube so as to maintain a portion of the vaporized components vaporized.

12. The vehicle mounted oil recovery system as claimed in claim 1, wherein said retort system further includes:

an additional sloping tube;

said additional sloping tube having a first end and a second end such that a slope from said first end to said second end is downward;

said first end of said sloping tube and said first end of said additional sloping tube being connected;

a first controllable supplemental heat source to provide supplemental heat to said sloping tube so as to maintain a portion of the vaporized components vaporized;

a second controllable supplemental heat source to provide supplemental heat to said additional sloping tube so as to maintain a portion of the vaporized components vaporized; and a cooling apparatus to provide cooling to said sloping tube so as to condense a portion of the vaporized components and provide additional pyrolysis of the condensed components.

13. The vehicle mounted oil recovery system as claimed in claim 1, wherein said retort system further includes:

an additional sloping tube;

said additional sloping tube having a first end and a second end such that a slope from said first end to said second end is downward;

said first end of said sloping tube and said first end of said additional sloping tube being connected;

a first controllable supplemental heat source to provide supplemental heat to said sloping tube so as to maintain a portion of the vaporized components vaporized;

a second controllable supplemental heat source to provide supplemental heat to said additional sloping tube so as to maintain a portion of the vaporized components vaporized;

a first cooling apparatus to provide cooling to said sloping tube so as to condense a portion of the vaporized components and provide additional pyrolysis of the condensed components; and a second cooling apparatus to provide cooling to said additional sloping tube so as to condense a portion of the vaporized components for use in the engine lubricating system of the vehicle.

14. The vehicle mounted oil recovery system as claimed in claim 1, further comprising:

a metering device to meter oil extracted from the engine lubricating system of the vehicle to said retort system.

15. The vehicle mounted oil recovery system as claimed in claim 1, further comprising:

a conduit to transport oil from an engine lubricating system of the vehicle to said retort system.

16. The vehicle mounted oil recovery system as claimed in claim 15, further comprising:

a cyclonic/centrifugal sludge remover to remove sludge and water from the oil; and a second conduit to convey the removed sludge and water to said retort system.

17. The vehicle mounted oil recovery system as claimed in claim 1, further comprising:

an oil filter medium pocket, mounted upon said sloping tube, to receive a removable filter element;

said oil filter medium pocket receiving heat from said sloping tube to pyrolyze and distill oil components within the removable filter element.

18. The vehicle mounted oil recovery system as claimed in claim 17, further comprising:

a controllable supplemental heat source to provide supplemental heat to said oil filter medium pocket and said sloping tube.

19. The vehicle mounted oil recovery system as claimed in claim 1, further comprising:

an oil filter retort to receive a used oil filter;

said oil filter retort being mounted directly upon an exhaust system of the vehicle;

said oil filter retort system capturing heat from the exhaust system of the vehicle to provide energy to pyrolyze and distill the oil within the used oil filter into vaporized components.

20. The vehicle mounted oil recovery system as claimed in claim 1, wherein said sloping tube is a corrugated tube.

21. A method for recovering used oil using an exhaust system of a vehicle, comprising:

(a) extracting combustion heat from the exhaust system of the vehicle;

(b) vaporizing, in a retort tube, using the extracted combustion heat from the exhaust system of the vehicle, fuel and water from used oil to produce sludge and an oil of high molecular weight hydrocarbons;

(c) collecting the sludge and oil of high molecular weight hydrocarbons in a retort chamber; and (d) pyrolyzing, in the retort chamber, using the extracted combustion heat from the exhaust system of the vehicle, the sludge and oil of high molecular weight hydrocarbons into low molecular weight hydrocarbon vapors.

22. The method as claimed in claim 21, further comprising:

(d) providing the vaporized fuel vapors, water vapors, and low molecular weight hydrocarbon vapors to a fuel system of the vehicle for combustion thereof.

23. The method as claimed in claim 21, further comprising:

(d) cooling the vaporized fuel, the vaporized water, the low molecular weight vapors, and the high molecular weight vapors so as to condense high molecular weight vapors;

(e) providing non-condensed vapors to a fuel system of the vehicle for combustion thereof; and (f) providing the condensed vapors to the retort system for additional pyrolysis.

24. The method as claimed in claim 21, further comprising:

(d) cyclonically/centrifugally removing sludge and water from the used oil; and (e) providing the removed sludge and water to the retort system.

25. The method as claimed in claim 21, further comprising:

(d) cyclonically/centrifugally removing sludge and water from the used oil; and (e) metering the removed sludge and water to the retort system.

26. A method for recovering oil using an exhaust system of a vehicle, comprising:

(a) extracting combustion heat from the exhaust system of the vehicle;

(b) vaporizing using the extracted combustion heat from the exhaust system of the vehicle, fuel and water from the used oil to produce sludge and an oil of high molecular weight hydrocarbons;

(c) pyrolyzing, using the extracted combustion heat from the exhaust system of the vehicle, the sludge and oil of high molecular weight hydrocarbons into low molecular weight hydrocarbon vapors; and (d) cooling the vaporized fuel, the vaporized water, and the low molecular weight hydrocarbon vapors so as to condense vaporized oil components into usable lubricating oil;

(e) providing non-condensed components to a fuel system of the vehicle for combustion thereof; and (f) providing the condensed vaporized oil components to the engine lubricating system of the vehicle.

* * * * *